US007823998B2

(12) United States Patent
Kuwahara et al.

(10) Patent No.: US 7,823,998 B2
(45) Date of Patent: Nov. 2, 2010

(54) LIQUID EJECTION APPARATUS AND LIQUID EJECTION METHOD

(75) Inventors: Soichi Kuwahara, Kanagawa (JP); Kazuyasu Takenaka, Tokyo (JP); Iwao Ushinohama, Kanagawa (KP); Yuichiro Ikemoto, Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 11/981,334

(22) Filed: Oct. 30, 2007

(65) Prior Publication Data

US 2008/0068414 A1 Mar. 20, 2008

Related U.S. Application Data

(62) Division of application No. 10/524,398, filed as application No. PCT/JP2004/008767 on Jun. 16, 2004.

(30) Foreign Application Priority Data

Jun. 16, 2003 (JP) ..... 2003-170269

(51) Int. Cl.

| | |
|---|---|
| ***B41J 29/38*** | (2006.01) |
| ***B41J 2/15*** | (2006.01) |
| ***B41J 2/155*** | (2006.01) |
| ***B41J 2/05*** | (2006.01) |

(52) U.S. Cl. ..... 347/13; 347/40; 347/42; 347/57

(58) Field of Classification Search ..... 347/9, 347/13, 40, 42, 48, 57

See application file for complete search history.

(56) References Cited

U.S. PATENT DOCUMENTS

| | | | |
|---|---|---|---|
| 5,173,717 A | 12/1992 | Kishida et al. | |
| 5,357,268 A | 10/1994 | Kishida et al. | |
| 2004/0012649 A1 | 1/2004 | Eguchi et al. | |
| 2004/0036723 A1 * | 2/2004 | Eguchi et al. | 347/9 |

FOREIGN PATENT DOCUMENTS

| | | |
|---|---|---|
| EP | 1 391 303 | 2/2004 |
| JP | 03-227632 | 10/1991 |
| JP | 09-286107 | 11/1997 |

(Continued)

*Primary Examiner*—Matthew Luu
*Assistant Examiner*—Jannelle M Lebron
(74) *Attorney, Agent, or Firm*—Robert J. Depke; Rockey, Depke & Lyons, LLC

(57) ABSTRACT

Even when ejection characteristics of ink droplets are dispersed between unit heads and when arrangement accuracies of unit heads are dispersed, stripe unevenness is alleviated by correction corresponding to each unit head. In a liquid ejection apparatus having a line head (10) arranged by juxtaposing a plurality of (unit) heads (11) of liquid ejection parts so as to connect the head (11) to the adjacent head (11), the liquid ejection apparatus includes ejection direction changing means for enabling the ejection direction of liquid droplets ejected from a nozzle of each liquid ejection part to change in a plurality of directions in the arranging direction of liquid ejection parts and reference direction setting means for individually setting one reference principal direction for each head (11) among a plurality of ejection directions of liquid droplets by the ejection direction changing means. In the (N−1)th and the (N+1)th head 11, the third ejection direction from the left is established as the principal direction while in the Nth head 11, the second ejection direction from the right is established as the principal direction.

11 Claims, 30 Drawing Sheets

FOREIGN PATENT DOCUMENTS

| | | |
|---|---|---|
| JP | 2001-105584 | 4/2001 |
| JP | 2001-150657 | 6/2001 |
| JP | 2002-096462 | 4/2002 |
| JP | 2002-036522 | 5/2002 |
| JP | 2002-192727 | 7/2002 |
| JP | 2002-240287 | 8/2002 |
| JP | 2002-254649 | 9/2002 |
| JP | 2003-080696 | 3/2003 |
| JP | 2003-136728 | 5/2003 |
| JP | 2003-276202 | 9/2003 |
| JP | 2004-58649 | 2/2004 |
| JP | 2004-167756 | 6/2006 |

* cited by examiner

| EACH SWICH STATE | | | | DOT LANDING POSITION | | | | | | | |
|---|---|---|---|---|---|---|---|---|---|---|---|
| Dpx | D6 | D5 | D4 | −3 | −2 | −1 | 0 | +1 | +2 | +3 | |
| 0 | 0 | 0 | 0 | | | | ● | | | | |
| | | 1 | | | | ● | | | | | |
| | 1 | 0 | | | ● | | | | | | |
| | | 1 | | ● | | | | | | | |
| 1 | 0 | 0 | | | | | ● | | | | |
| | | 1 | | | | | | ● | | | |
| | 1 | 0 | | | | | | | ● | | |
| | | 1 | | | | | | | | ● | |

FIG. 28A

| EACH SWICH STATE | | | | DOT LANDING POSITION | | | | | | | |
|---|---|---|---|---|---|---|---|---|---|---|---|
| Dpx | D6 | D5 | D4 | 0 | 1 | 2 | 3 | 4 | 5 | 6 | 7 |
| 0 | 1 | 1 | 1 | ● | | | | | | | |
| | | 0 | | | ● | | | | | | |
| | 0 | 1 | | | | ● | | | | | |
| | | 0 | | | | | ● | | | | |
| 1 | 0 | 0 | | | | | | ● | | | |
| | | 1 | | | | | | | ● | | |
| | 1 | 0 | | | | | | | | ● | |
| | | 1 | | | | | | | | | ● |

FIG. 28B

LIQUID EJECTION APPARATUS AND LIQUID EJECTION METHOD

The subject matter of application Ser. No. 10/524,398 is incorporated herein by reference. The present application is a divisional of U.S. application Ser. No. 10/524,398, filed Feb. 11, 2005, which claims priority to PCT Patent application No. PCT/JP2004/008767, filed Jun. 16, 2004, which claims priority to Japanese Patent Application No. JP2003-170269, filed Jun. 16, 2003. The present application claims priority to these previously filed applications.

TECHNICAL FIELD

The present invention relates to a liquid ejection apparatus having a line head arranged by juxtaposing a plurality of liquid ejection parts of unit heads so as to connect the unit head to the adjacent unit head, each unit head having at least part of the liquid ejection part for ejecting ink droplets from a nozzle, and a liquid ejection method using the line head having a plurality of the unit heads by juxtaposing a plurality of the unit heads so as to connect the unit head to the adjacent unit head, each unit head having at least part of the liquid ejection part for ejecting ink droplets from the nozzle.

In detail, the present invention relates to a technique in that the ejecting direction of ink droplets is individually set for each unit head so that every unit heads constituting the line head can eject ink droplets in directions appropriately for each unit head.

BACKGROUND ART

An ink-jet printer has been known as an example of the liquid-ejecting apparatus. As the ink-jet printer, there have been known a serial system, in which while ink droplets ejected from a head moving in the lateral direction of a recording medium are landed on the recording medium moving, the recording medium is moved in a conveying direction, and a line system having a line head arranged along the entire width of the recording medium so as to move only the recording medium in a direction perpendicular to the lateral direction of the recording medium while ink droplets ejected from the line head are landed on the recording medium.

Furthermore, as is disclosed in Japanese Unexamined Patent Application Publication No. 2002-36522, the line head has been known to have a structure having a plurality small head chips (referred to as a unit head below) juxtaposed so as to connect the unit heads together at their ends so that liquid ejection parts, each part being composed of each unit head, are arranged along the entire width of photographic paper.

In the line printer, as is disclosed in Japanese Unexamined Patent Application Publication No. 2002-192727, a technique is known in that by providing each ejection part with a head having a plurality of independently controllable heating regions arranged for changing the ejecting direction of ink, when the ejection part becomes non-ejection, the printing is performed while dots of the non-ejection part are complemented with normal dots of other ejection parts.

Furthermore, as is disclosed in Japanese Unexamined Patent Application Publication No. 2001-105584, a technique is known in that each ejection part is provided with at least two energy generating elements so that ink droplets are ejected from the ejection parts in a plurality of directions by controlling the two energy generating elements while the ink-ejecting directions are varied at random. In Publication, it is described that the line system may be incorporated.

However, in conventional techniques, when the line head is formed, the number of ejection parts is larger than that in the serial system, so that a problem arises that dispersion in ink-ejection characteristics is increased.

In the serial system, even when the ink-ejection characteristics vary to some extent, by adopting a technique called as "overlapping ejection" in that dots are arranged so as to overlap with dots arranged in advance for filling up gaps, the dispersion can be made in inconspicuous states.

Whereas, in the line system, since the head is not moved, the overlapping ejection cannot be performed by recording dots on the once recorded region. Hence, dispersion inherent in the ejection part remains in the arranging direction of the ejection parts, so that a problem arises in that stripe unevenness is conspicuous.

In particular, as is disclosed in Japanese Unexamined Patent Application Publication No. 2002-365522, when the line head is formed by connecting a plurality of unit heads together, there is a problem that dispersion may be generated in joint clearances between the unit heads.

FIG. 29 is a drawing showing ejecting directions of ink droplets and landed positions of the ink droplets in a line head having a plurality of unit heads 1 (simply referred to as "heads 1" below) juxtaposed so as to connect them together between the heads 1. In the drawing, the upper portion shows the arrangement of the heads 1 and the ejecting directions of ink droplets in front view; the lower portion shows the arrangement of dots landed on photographic paper P in plan view (in the same way as in drawings below).

In FIG. 29, three heads 1 of Nth, (N+1)th, and (N−1)th head 1, are only shown; however, a further large number of the heads 1 are juxtaposed in the lateral direction of the drawing in practice. In each head 1, liquid ejection parts (each including a nozzle and having an ejection function of ink droplets) are arranged at a constant pitch P (about 42.3 μm at a resolution of 600 DPI, for example).

Furthermore, the heads 1 are juxtaposed so as to have also a pitch P of joints between the heads 1, the joint between the liquid ejection part positioned at the right most of the Nth head 1 and the liquid ejection part positioned at the left most of the (N+1)th head 1, for example.

Accordingly, as shown in FIG. 29, when ink droplets are ejected from each liquid ejection part of each head 1 in arrow direction of the drawing, the entire dots are arranged at the pitch P in the width direction of photographic paper (arranging direction of liquid ejection parts (lateral direction of the drawing)).

The above-description is the case when the entire heads 1 are arranged at predetermined positions while the ejecting direction of ink droplets of each head 1 is constant. However, in practice, this does not necessarily happen.

For example, as shown in FIG. 30, if the Nth head 1 is displaced to a position closer to the (N−1)th head 1, the Nth head 1 is arranged at a position further than the (N+1)th head 1.

Hence, as shown in FIG. 30, ink droplets ejected from the liquid ejection part positioned at the right most in the drawing of the (N−1)th head 1 excessively approach ink droplets ejected from the liquid ejection part positioned at the left most in the drawing of the Nth head 1, so that a conspicuous stripe A is unfavorably produced in the boundary between the heads 1 in the conveying direction of photographic paper P (vertical direction in the drawing). Similarly, ink droplets ejected from the liquid ejection part positioned at the right most in the drawing of the Nth head 1 are excessively separated from ink droplets ejected from the liquid ejection part positioned at the left most in the drawing of the (N+1)th head 1, so that a conspicuous white stripe A is unfavorably produced.

Also, as shown in FIG. 31, although the (N−1)th, Nth, and (N+1)th head 1 are arranged at predetermined intervals, respectively, there may be a head 1 with an ejecting direction different from those of other heads 1, such that the ejecting direction of ink droplets ejected from the liquid ejection part of the Nth head 1 is inclined to the (N−1)th head 1, for example. This is because ejection characteristics, such as ejecting directions, vary for every the heads 1 due to errors in manufacturing.

In this case, even when every heads 1 is improved in accuracy, dots are arranged in the same way as those in FIG. 30, so that a conspicuous stripe A or white stripe B may be unfavorably produced in the boundary between the heads 1 in the same way as described above.

However, it is extremely difficult to improve the arrangement accuracy of every heads 1 as well as to unify ejection characteristics of every heads 1 for making the stripe A or the white stripe B inconspicuous. Even if it could be possible, there may be a problem of considerably increased manufacturing cost.

In the technique disclosed in Japanese Unexamined Patent Application Publication No. 2002-192727, when a liquid ejection part becomes non-ejective, the dots can be complemented with other normal liquid ejection parts. However, when a line head is formed so as to connect the heads 1 together, if there is displacement between heads 1 of ejection characteristics, the dots cannot be complemented by the technique of Japanese Unexamined Patent Application Publication No. 2002-192727.

Furthermore, in the technique disclosed in Japanese Unexamined Patent Application Publication No. 2001-105584, stripe unevenness can be alleviated by changing the ink ejecting direction at random. However, if the ejecting direction may be changed at random, the range of the changes has a predetermined limit. That is, if the ejecting direction is changed at random so as to exceed the predetermined limit, exact pixels cannot be formed. As described above, if the line head is formed so as to connect the heads 1 together, the ejection characteristics may be displaced so as to exceed a limit allowable for alleviating stripe unevenness by changing the ejecting direction. In such a case, the stripe unevenness may not be made inconspicuous by only changing the ejecting direction at random.

DISCLOSURE OF INVENTION

Accordingly, it is an object of the present invention to alleviate stripe unevenness for improving printing quality by correction corresponding to each unit head even when ejection characteristics, such as ejection directions of ink droplets, are dispersed and when arrangement accuracies of unit heads are dispersed.

The present invention solves the above-object by the following solving means.

In a liquid ejection apparatus according to the present invention having a line head arranged by juxtaposing a plurality of liquid ejection parts of unit heads so as to connect the unit head to the adjacent unit head, each unit head having at least part of the liquid ejection part for ejecting ink droplets from a nozzle, the liquid ejection apparatus includes principal control means for controlling each of the liquid ejection part to eject liquid droplets from the nozzle; auxiliary control means for controlling liquid droplets to be ejected in at least one direction different from the ejection direction controlled by the principal control means in the arranging direction of the liquid ejection parts; and auxiliary control execution determining means for individually setting whether the auxiliary control means is executed for each of the unit head.

According to the present invention described above, it is determined whether the auxiliary control means is executed for each unit head by toe auxiliary control execution determining means. Herein, when ink droplets are ejected by the principal control means, if the ejection direction is different from that of other unit heads, the auxiliary control means is executed.

In a liquid ejection apparatus according to another aspect of the present application having a line head arranged by juxtaposing a plurality of liquid ejection parts of unit heads so as to connect the unit head to the adjacent unit head, each unit head having at least part of the liquid ejection part for ejecting ink droplets from a nozzle, the liquid ejection apparatus includes ejection direction changing means for enabling the ejection direction of liquid droplets ejected from the nozzle of each of the liquid ejection part to change in at least two different directions in the arranging direction of the liquid ejection parts; and reference-direction setting means for individually setting one reference principal direction for each of the unit head among a plurality of ejection directions of liquid droplets established by the ejection direction changing means.

According to the above aspect, the ejection direction changing means is provided for each unit head, so that liquid droplets can be ejected in at least two different directions in the arranging direction of the liquid ejection parts.

Then, any one reference principal direction is individually set for each of the unit head by the reference-direction setting means.

Furthermore, in a liquid ejection apparatus according to another aspect of the present application having a line head arranged by juxtaposing a plurality of liquid ejection parts of unit heads so as to connect the unit head to the adjacent unit head, each unit head having at least part of the liquid ejection part for ejecting ink droplets from a nozzle, the liquid ejection apparatus includes ejection direction changing means for enabling the ejection direction of liquid droplets ejected from the nozzle of each of the liquid ejection part to change in at least two different directions in the arranging direction of the liquid ejection parts, and ejecting-angle setting means for individually setting liquid droplets established by the ejection direction changing means for each of the unit head.

In the above aspect, the ejection direction changing means is provided for each liquid ejection part of the unit head, so that ink droplets can be ejected in at least two different directions in the arranging direction of liquid ejection parts.

Then, for each unit head, the ejecting angle of liquid droplets is individually set by the ejecting-angle setting means.

BRIEF DESCRIPTION OF THE DRAWINGS

FIGS. 28A and 28B are tables showing the relationship between states of a polarity changing switch and turning on/off states of a first ejection control switch; and changes in landing position of dots in the arranging direction of nozzles.

BEST MODE FOR CARRYING OUT THE INVENTION

An embodiment according to the present invention will be described below with reference to the drawings. In this specification, "ink droplets" represent a micro-amount (about several pico-liters) of ink ejected tom a nozzle 18, which will be described later, of a liquid ejection part. A "dot" denotes a landed formation of one ink droplet formed on a recording medium, such as photographic paper. A "pixel" is defined by a minimal unit of an image; a "pixel region" denotes a region for forming pixels.

On one pixel region, a predetermined number of ink droplets (zero, one, or a plurality of droplets) are landed so as to form a pixel without a dot (one-step gradation), a pixel with one dot (two-step gradation), and a pixel with a plurality of dots (three-step or more gradation). That is, one pixel region corresponds to zero, one, or a plurality of dots. Thus, a large number of these pixels are arranged on a recording medium so as to form images.

The dots corresponding to the pixel are not completely contained within the corresponding pixel region, and some dots may lie off the pixel region.

(Head Structure)

Figure 1:
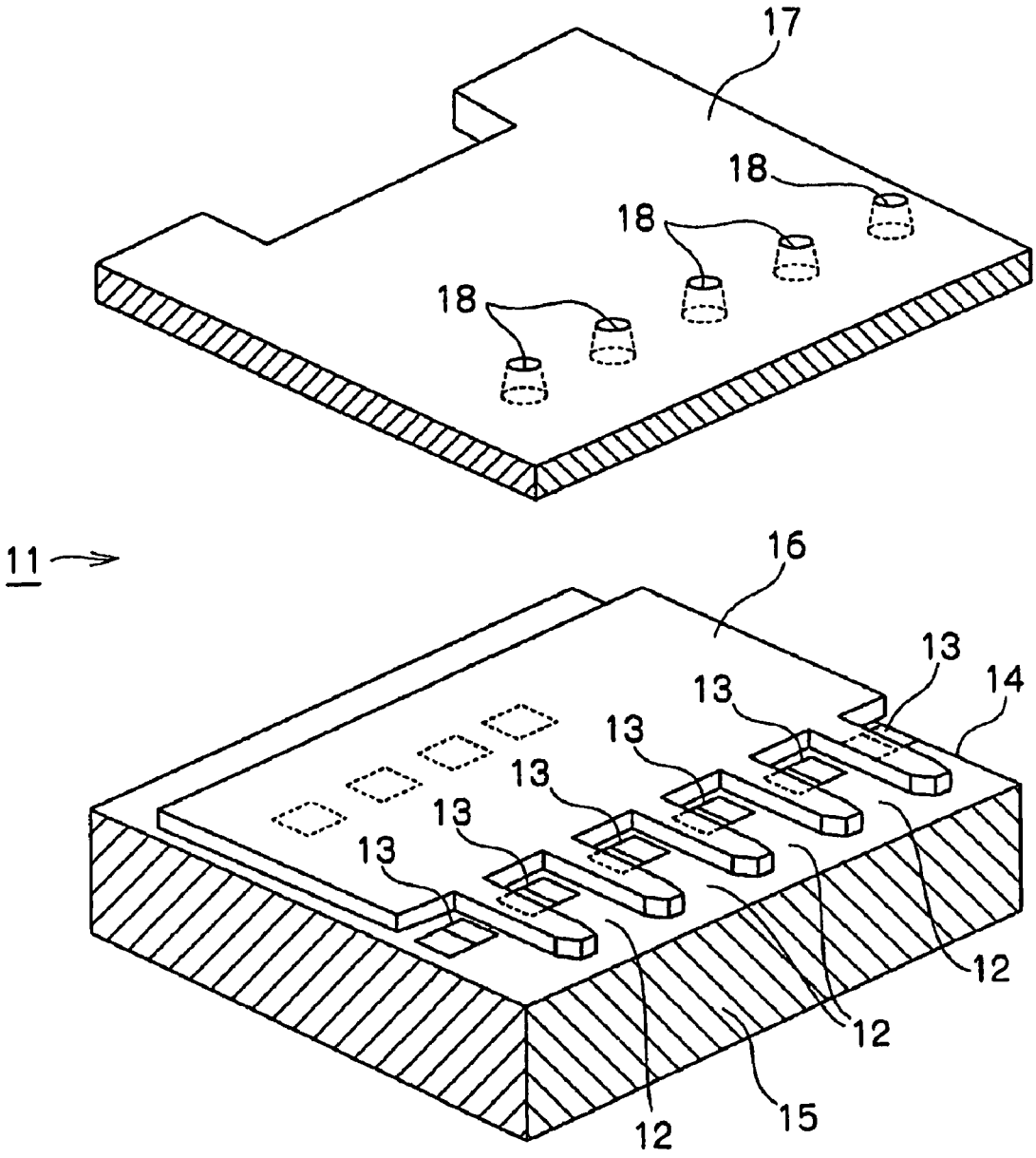
FIG. 1 is an exploded perspective view of a head of an ink-jet printer incorporating the liquid ejection apparatus according to the present invention.

FIG. 1 is an exploded perspective view of a unit head 11 (simply referred to a head 11 below) of an ink-jet printer (simply referred to a printer below) incorporated in a liquid ejection apparatus according to the present invention.

The head 11 shown in FIG. 1 is composed of a plurality of juxtaposed liquid ejection parts. The liquid ejection part includes an ink chamber 12 for containing liquid to be ejected, a heating resistor 13 (equivalent to bubble-generating means or a heating element according to the present invention) arranged within the ink chamber 12 for generating bubbles in the liquid contained in the ink chamber 12 by supplying energy, and a nozzle sheet 17 (equivalent to a nozzle-forming member according to the present invention) having nozzles 18 formed thereon for ejecting liquid operatively associated with the bubble generation by the heating resistor 13.

Referring to FIG. 1, the nozzle sheet 17 is bonded on a barrier layer 16, and the nozzle sheet 17 is shown by being exploded in the drawing.

In the head 11, a substrate member 14 includes a semiconductor substrate 15 made of silicon, etc. and the heating resistors 13 deposited on one surface of the semiconductor substrate 15. The heating resistor 13 is electrically connected to an external circuit via a conduction part (not shown) formed on the semiconductor substrate 15.

The barrier layer 16 is formed of a photo-sensitive cyclized-rubber resist or an exposure curing dry-film resist deposited on the entire surface, on which the heating resistors 13 are formed, of the semiconductor substrate 15 so that unnecessary parts are then removed by a photolithographic process.

Furthermore, the nozzle sheet 17 having a plurality of the nozzles 18 is made by an electrocasting technique with nickel, and is bonded on the barrier layer 16 so that positions of the nozzles 18 agree with those of the heating resistors 13, i.e., the nozzles 18 oppose the heating resistors 13, respectively.

The ink chamber 12 is constituted of the substrate member 14, the barrier layer 16, and the nozzle sheet 17 so as to surround the heating resistor 13. That is, in the drawing, the substrate member 14 forms the bottom wall of the ink chamber 12; the barrier layer 16 forms side walls of the ink chamber 12; and the nozzle sheet 17 forms the top wall of the ink chamber 12. Thus, the ink chamber 12 has an opening region in front right of FIG. 1, and the opening region is communicated with an ink flow path (not shown).

The above-mentioned one head 11 generally includes the ink chambers 12 in units of several tens to several hundreds and the heating resistors 13 arranged within each of the ink chambers 12. By the command from a control unit of the printer, the heating resistor 13 can be respectively selected so as to eject ink contained in the ink chamber 12 corresponding to the heating resistor 13 from the nozzle 18 opposing the ink chamber 12.

That is, the ink chamber 12 is filled with ink from an ink tank (not shown) connected to the head 11. Then, by applying a pulse electric current to the heating resistor 13 for a short time, such as 1 to 3 μs, the heating resistor 13 is rapidly heated, resulting in generating gas-phase bubbles in ink contacting the heating resistor 13 so as to push aside some volume of ink (ink is evaporated) by the expansion of the ink bubbles. Thereby, ink contacting the nozzle 18 with the same volume as that of pushed ink is ejected from the nozzle 18 as ink droplets, and is landed on photographic paper so as to form dots (pixels) thereon.

Figure 2:
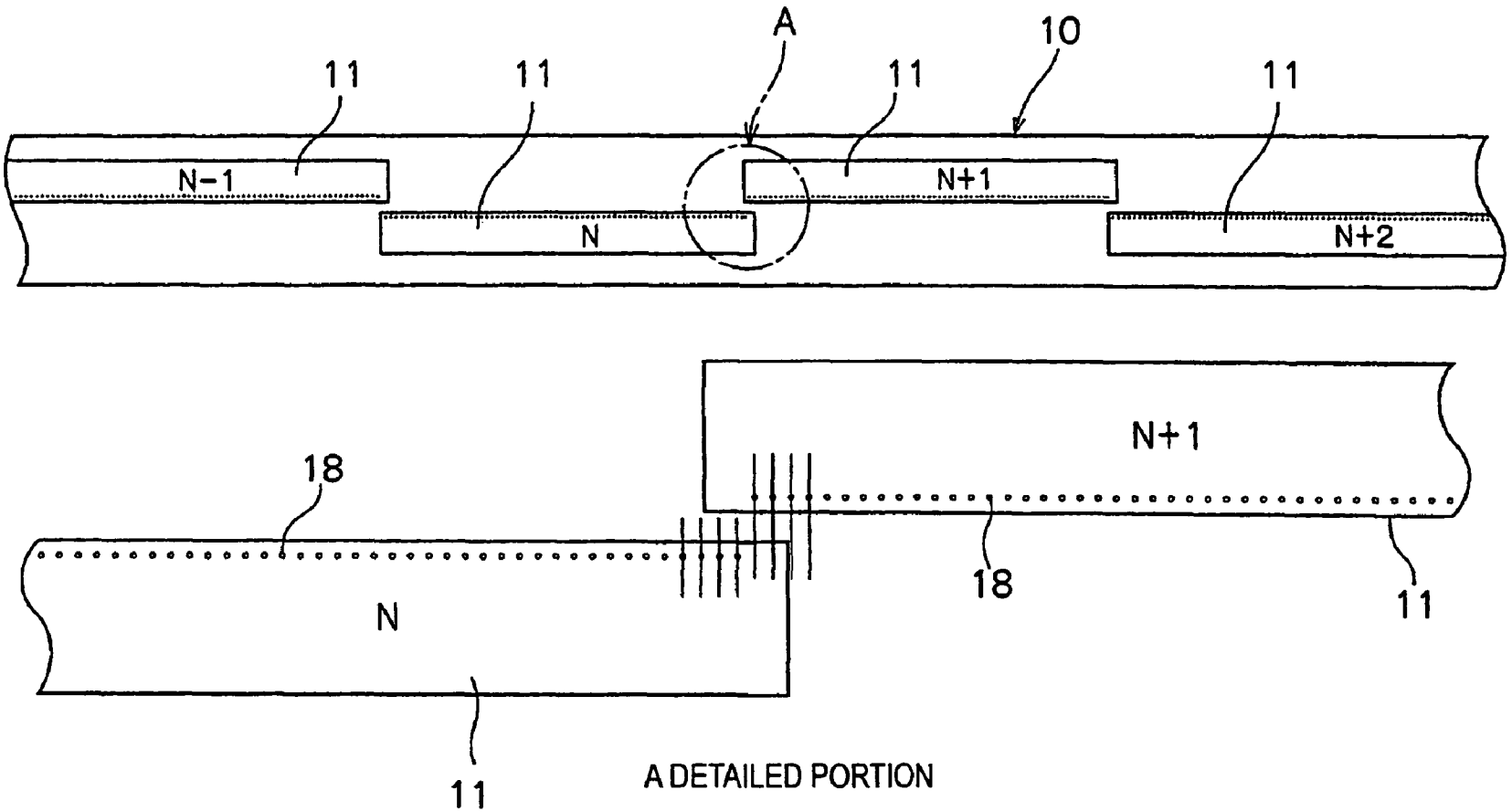
FIG. 2 is a plan view of an embodiment of a line head.

Furthermore, according to the embodiment, the line head is formed to have a plurality of the liquid ejection parts of the heads 11 arranged by placing a plurality of the heads 11 in an arranging direction of the liquid ejection parts (arranging direction of the nozzles 18 or the width direction of a recording medium) so as to connect the heads 11 together. FIG. 2 is a plan view showing an embodiment of a line head 10. In FIG. 2, the four heads 11 ((N−1), (N), (N+1), and (N+2)) are shown; however, a further large number of the heads 11 are arranged so as to connect them together.

In order to form the line head 10, a plurality of parts of the heads 11 other than the nozzle sheet 17 (head chips) shown in FIG. 1 are first juxtaposed.

Then, on the top of these head chips, one nozzle sheet 17 having the nozzles 18 formed right above each of the heating resistors 13 of the entire head chips is bonded so as to form the line head 10.

In FIG. 2, the line head 10 with one color is shown; a plurality of the line heads 10 may be provided so as to supply different color ink for each of the line heads 10 for forming a color line head.

While the heads 11 adjacent to each other are arranged in one side and the other side, respectively across an ink flow path, the heads 11 on the one side oppose the heads 11 on the other side, i.e., the heads 11 are arranged so that the nozzles 18 oppose each other (a so-called staggered arrangement). That is, in FIG. 2, a portion sandwiched by a line connecting external peripheries, adjacent to the nozzles 18, of the (N−1) th head 11 and the (N+1)th head 11 together and a line connecting external peripheries, adjacent to the nozzles 18, of the Nth head 11 and the (N+2)th head 11 together is the ink flow path of this line head 10.

Furthermore, the heads 11 are arranged so that the pitch between the nozzles 18 at ends of the heads 11 adjacent to each other, i.e., in detailed A portion of FIG. 2, the space between the nozzle 18 at the right most of the Nth head 11 and the nozzle 18 at the left most of the (N+1)th head 11, is identical to the space between the nozzles 18 of the head 11.

In addition, other than the staggered arrangement described above, the liquid ejection parts of each head 11 may also be arranged linearly (as straight as a line). That is, in FIG. 2, the Nth and the (N+2)th head 11 may also be arranged identically to the (N−1)th and the (N+1)th head 11 in their directions.

In FIG. 2, the liquid ejection parts of each head 11 are arranged substantially in parallel with the juxtaposing direction of the heads 11; alternatively, the liquid ejection parts of each head 11 may be arranged in a line slanting to the right in FIG. 2. Alternatively, while the liquid ejection parts of the head 11 are divided into a plurality of groups, the liquid ejection parts belonging to each group may be arranged in a line slanting to the right in FIG. 2.

(Ejecting-Direction Changing Means or Principal Control Means and Auxiliary Control Means)

The head 11 also includes ejecting-direction changing means or principal control means and auxiliary control means.

According to the embodiment, the ejecting-direction changing means can change the ejecting direction of ink droplets ejected from the nozzle 18 of the liquid ejection part in at least two different directions of arranging directions of the liquid ejection parts.

More specifically, the ejecting-direction changing means includes the principal control means for controlling each of the liquid ejection parts to eject ink droplets from the nozzle 18 and the auxiliary control means for controlling ink droplets to eject in at least one direction different from the ejecting direction of the ink droplets by the principal control means of the arranging direction of the liquid ejection parts. According to the embodiment, the ejecting-direction changing means (the principal control means and the auxiliary control means) is constructed as follows.

Figure 3:
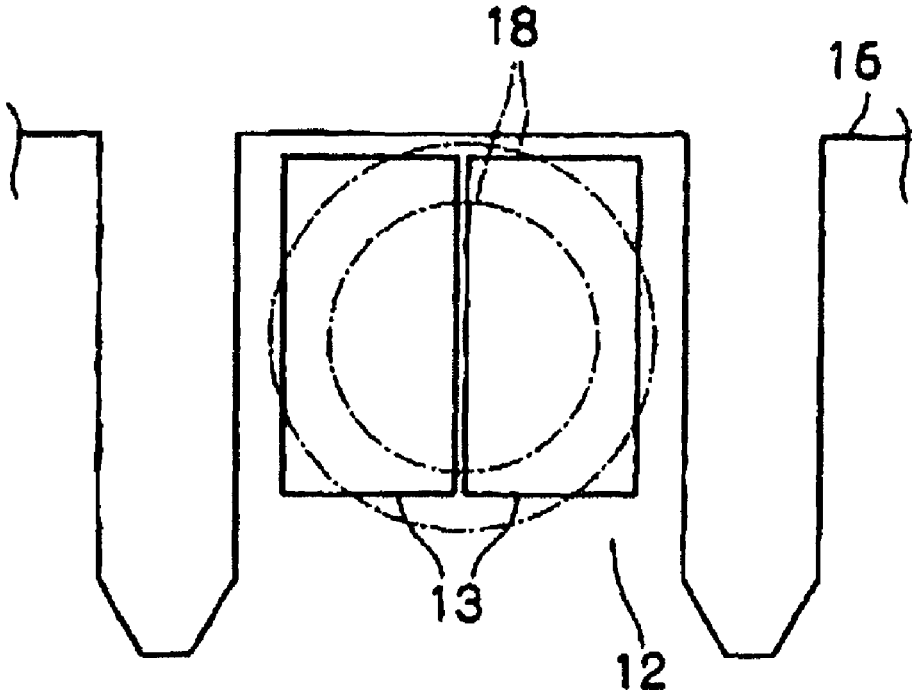
FIG. 3 includes a plan view and a sectional side view showing arrangement of heating resistors of the head in more detail.
Figure 3:
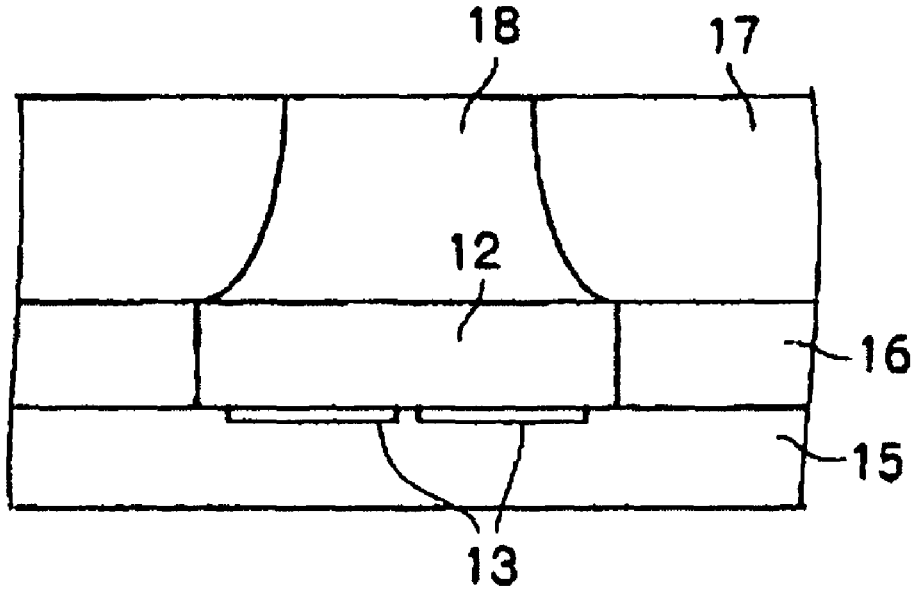

FIG. 3 includes a plan view and a sectional side view showing the arrangement of the heating resistors 13 of the head 11 in detail. The plan view of FIG. 3 additionally shows the position of the nozzle 18 with chain lines.

As shown in FIG. 3, in the head 11 according to the embodiment, within one ink chamber 12, the two divided heating resistors 13 are juxtaposed. Moreover, the arranging direction of the two divided heating resistors 13 is the arranging direction of the liquid ejection parts.

In the two-piece heating element 13 formed by longitudinally dividing one heating element 13 into two pieces in such a manner, since the width is halved while the length is the same, the resistance value is doubled. When these two pieces of the heating element 13 are connected in series, the heating elements 13 with doubled resistance are connected in series, resulting in quadrupling the resistance value.

In order to boil ink contained in the ink chamber 12, it is required to heat the heating element 13 by applying predetermined electric power to the heating element 13 because the ink is ejected by the energy during the boiling. When the resistance is small, the current must be increased; however, by increasing the resistance value of the heating element 13, the ink can be boiled with smaller current.

Thereby, a transistor for passing the current can also be reduced in size, resulting in space-saving. Reduction in thickness of the heating element 13 increases the resistance value; however, in view of the material selected for the heating element 13 and the strength (durability) thereof, the reduced thickness of the heating element 13 has a predetermined limit. Accordingly, without reducing the thickness, the resistance value is increased by dividing the heating element 13.

When the two-piece heating element 13 divided into two is provided within one ink chamber 12, and if the time required to reach an ink-boiling temperature (bubble generating time) by each piece of the heating element 13 is generally equalized, ink is boiled on the two heating elements 13 simultaneously, so that ink droplets are ejected in the axial direction of the nozzle 18.

If a time difference between the two pieces is generated in the bubble generating time of the heating element 13, ink is not boiled on the two heating elements 13 simultaneously, so that ink droplets are ejected away the axial direction of the nozzle 18 (deflected). Thereby, the ink droplets are landed at a position shifted off the landing position when ink droplets are ejected without deflection.

Figure 4A:
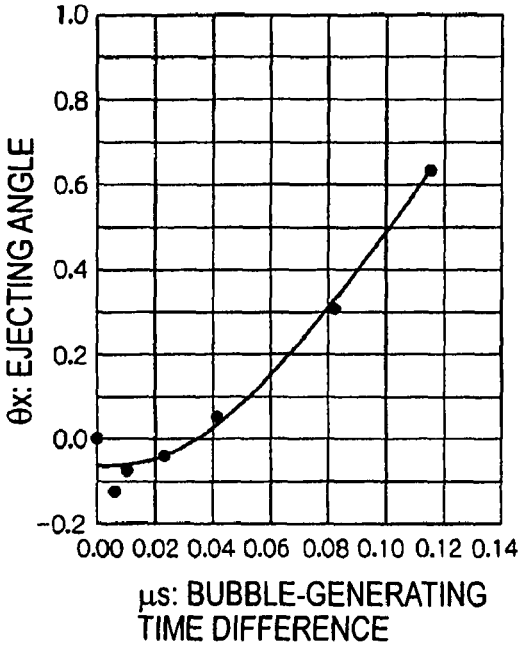
FIGS. 4A to 4C are graphs showing the relationship between an ink bubble-generating time difference between the heating resistors and the ejecting angle of ink droplets when the divided heating resistors are provided.
Figure 4B:
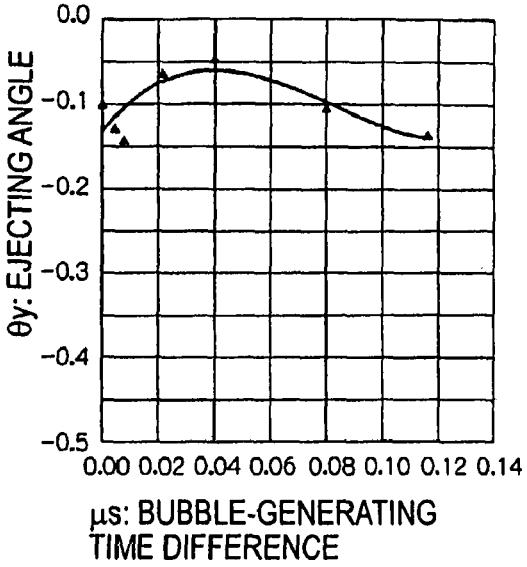

FIGS. 4A and 4B are graphs showing the relationship between the time difference in ink-bubble generation by the divided heating resistors 13 according to the embodiment and the ejecting angle of ink droplets. The values in the graphs are results from computer simulations. In these graphs, an X-direction (the direction shown by θx plotted on an ordinate, note: not the abscissa of the graphs) is the arranging direction of the nozzles 18 (juxtaposing direction of the heating resistors 13), and a Y-direction (the direction shown by θy plotted on the ordinate, note: not the ordinate of the graphs) is the direction perpendicular to the X-direction (conveying direction of photographic paper). In X- and Y-directions together, θx and θy are shown as shifted angles when they are zero when without deflection.

Figure 4C:
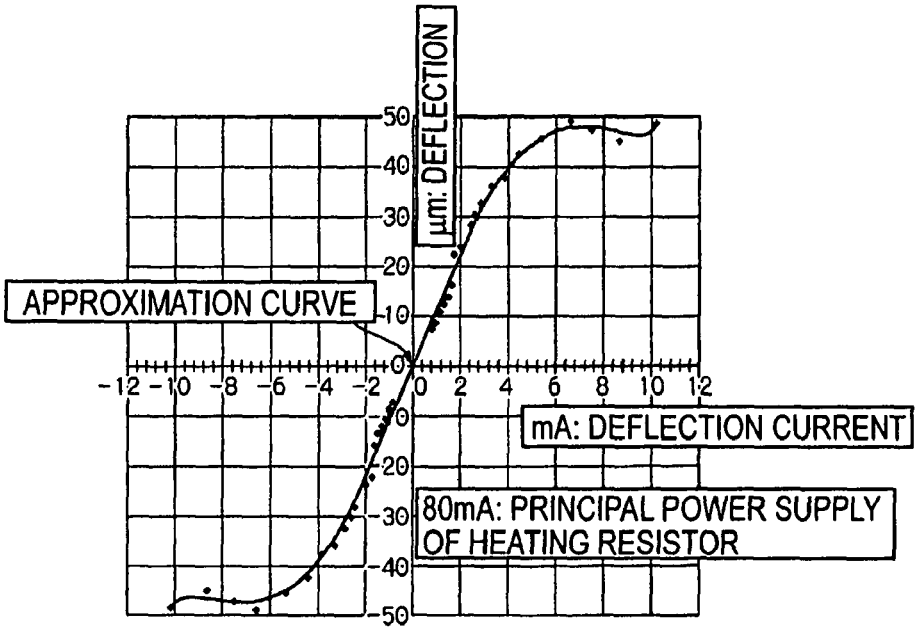

Furthermore, FIG. 4C shows measured data, in which half of the current difference between the two pieces of the divided heating element 13 as the bubble-generating time difference is plotted on an abscissa as a deflection current while a deflection at a landing position of an ink droplet (measured when the distance between the nozzle 18 and the landing position is about 2 mm) is plotted on an ordinate. In FIG. 4C, the deflected ejection of ink droplets was carried out by superimposing the deflection current thorough one piece of the heating element 13, where the principal current of the heating element 13 was 80 mA.

If a time difference between the two pieces is generated in the bubble generating time of the heating element 13, the ejecting angle of ink droplets becomes not normal, so that the ejection angle θx of the ink droplets is increased with increasing bubble-generating time difference.

Then, according to the embodiment, utilizing this characteristic, two divided heating elements 13 are provided, and by changing a current passing through each of the heating resistors 13, the two heating resistors 13 are controlled for producing a time difference in the bubble generating time so as to change the ejection of ink droplets in a plurality of directions.

Moreover, if resistance values of two pieces of the heating element 13 divided into two are not identical to each other because of errors in manufacturing, for example, the bubble-generating time difference is produced between the two pieces of the heating element 13, the ejecting angle of ink droplets deviates from the normal, so that the landing position of the ink droplets is deflected from their original position. However, by changing the current capacity to be applied to the divided heating element 13 so as to control the bubble-generating time of each piece of the divided heating element 13, the bubble-generating time can be matched with each other so as to make the ejecting angle of ink droplets normal.

Figure 5:
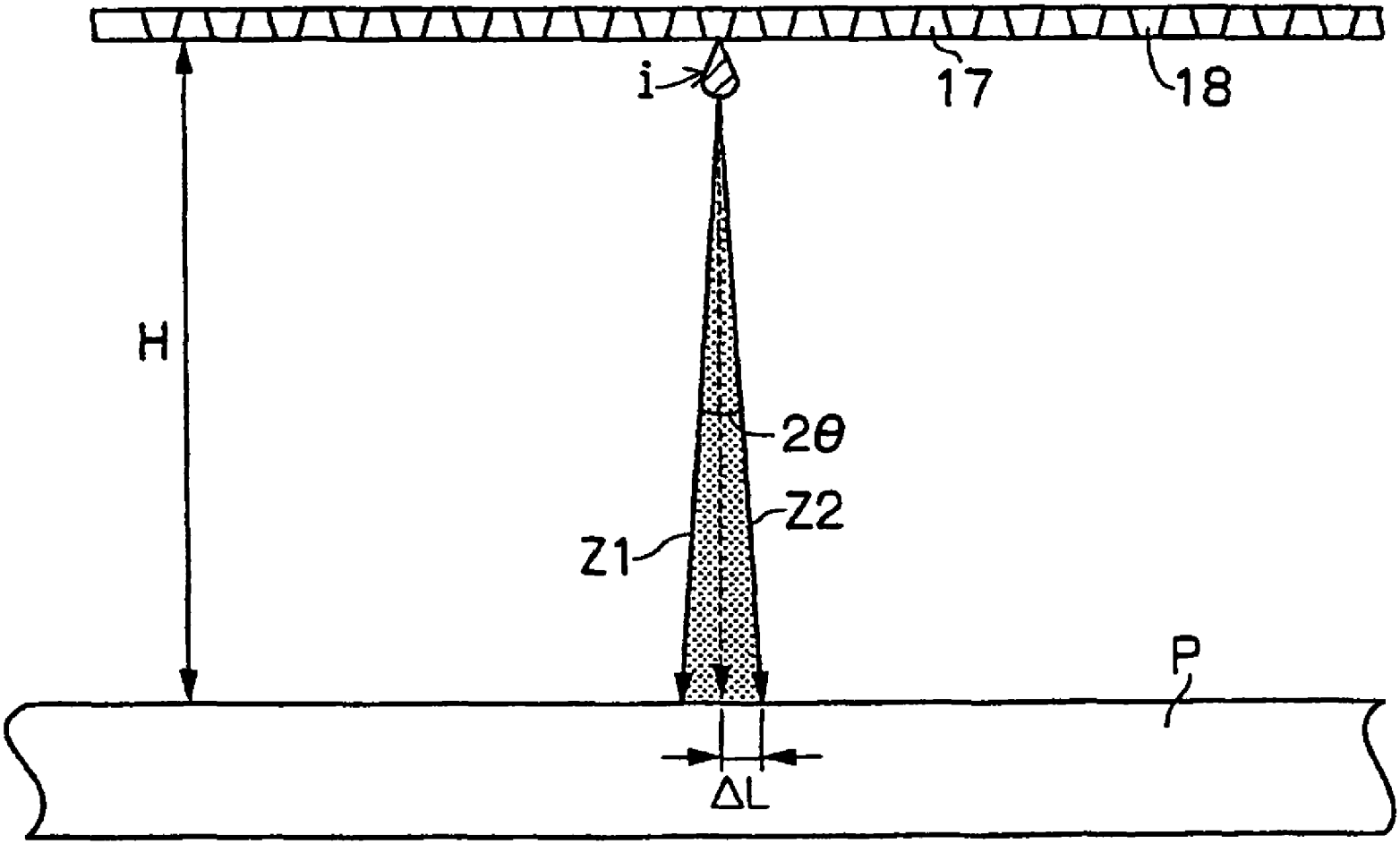
FIG. 5 is a drawing for illustrating the deflection in the ejection direction of ink droplets.

FIG. 5 is a drawing for illustrating the deflection in the ejecting direction of ink droplets. Referring to FIG. 5, when an ink droplet i is ejected normally to an ink-ejecting face of the ink droplet i (surface of photographic paper), the ink droplet i is ejected without deflection as the arrow shown by doted line in FIG. 5. Whereas, if the ejecting direction of the ink droplet i is deflected so that an ejecting angle deviates from normal by θ (Z1 or Z2 direction in FIG. 5), the landing position of the ink droplet i is deflected by:

$$\Delta L = H \times \tan\theta.$$

In such a manner, if the ejecting direction of the ink droplet i is deflected so that an ejecting angle deviates from normal by θ, the landing position of the ink droplet is deflected by ΔL.

Wherein the distance H between the end of the nozzle 18 and the surface of the photographic paper P is generally about 1 to 2 mm, so that the distance is assumed H=about 2 mm.

In addition, the reason to maintain the distance H substantially constant is that when the distance H changes, the landing position of the ink droplets i also changes. That is, when the ink droplets i are ejected from the nozzle 18 normally to the surface of the photographic paper P, even if the distance H changes to some extent, the landing position of the ink droplets i does not change. Whereas, when ink droplets i are ejected with deflection as described above, the landing position of the ink droplets i changes differently with changes in the distance H.

Also, when the resolution of the head 11 is 600 DPI, the space between the nozzles 18 adjacent to each other is: 25.40×1000/600=42.3 (μm).

(Auxiliary Control Execution Determining Means)

According to the embodiment, the line head 10 in a first mode includes the auxiliary control execution determining means in addition to the principal control means and the auxiliary control means.

The auxiliary control execution determining means is for individually determining whether the auxiliary control means is executed for each head 11.

Figure 6:
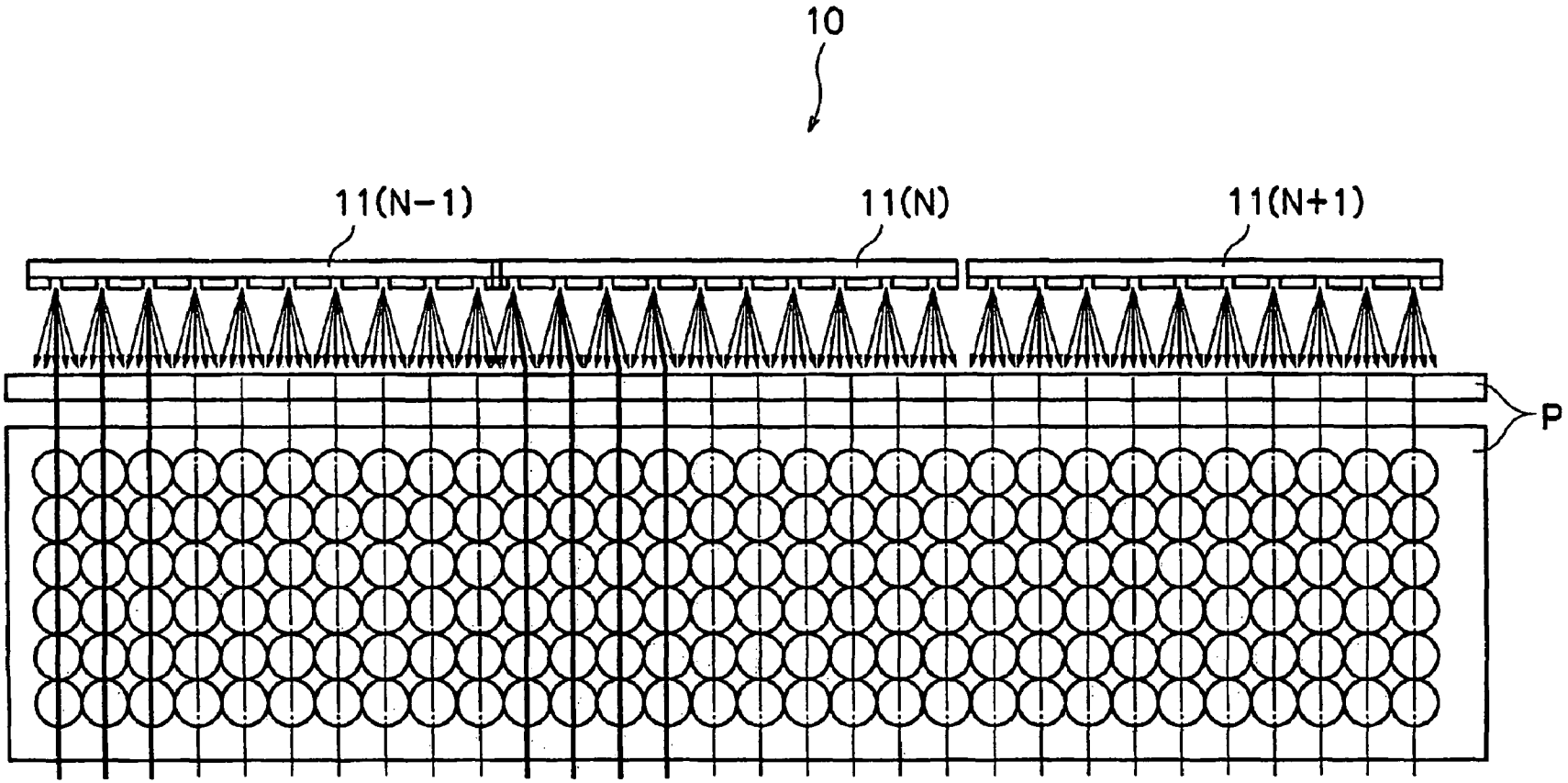
FIG. 6 is a drawing of an example in that landing positions of ink droplets are corrected by principal control means, auxiliary control means, and auxiliary control execution determining means.

FIG. 6 is a drawing of an example in that the landing position of ink droplets is corrected by the principal control means, the auxiliary control means, and the auxiliary control execution determining means. The upper portion of the drawing is a front view showing ejecting directions of ink droplets ejected from each head 11 and each liquid ejection part in the line head 10, wherein arrows show the entire ejecting directions by the principal control means and the auxiliary control means, when ink droplets are ejected from the liquid ejection parts of each head 11. Furthermore, heavy lines of the arrows show the selected ejecting directions. The lower portion of the drawing is a plan view showing a state in that ink droplets ejected from each liquid ejection part are landed on the photographic paper P (following drawings being displayed in the same way).

In the example shown in FIG. 6, while ink droplets are simply ejected from liquid ejection parts of each head 11 by using only the principal control means, by using the auxiliary control means as well, ink droplets are ejected in the ejecting direction different from that by the principal control means, specifically in two different directions on both lateral sides in the drawing, respectively. That is, each liquid ejection part has one ejecting direction by the principal control means and four ejecting directions by the auxiliary control means, five ejecting directions in total.

When ink droplets are to be ejected from liquid ejection parts of each head 11 directly underneath (in the substantially normal direction on the photographic paper P), it is principle to only use the principal control means without the auxiliary control means.

However, when ink droplets are ejected from the entire heads 11 using only the principal control means, if one head 11 has a landing positional displacement relative to other heads 11 due to positional error of the head 11, the head 11 is controlled to adjust the landing position using the auxiliary control means in addition to the principal control means.

In such a case, ink droplets are ejected from the entire heads 11 using only the principal control means so as print a test pattern, for example, and the printed result is read by an image reading device, such as an image scanner. Then, from the read result, the presence of the head 11 having the landing positional displacement relative to other heads 11 more than a predetermined value is detected. If the head 11 with the landing positional displacement relative to other heads 11 more than the predetermined value is detected, the displacement is further detected to have what extent displacement, and the head 11 is controlled to change the ejecting direction of ink droplets using the auxiliary control means.

FIG. 6 shows an example in that among the heads 11, the Nth head 11 is arranged closer to the (N−1)th head 11, so that the space between the Nth head 11 and the (N−1)th head 11 is reduced (the space between the Nth head 11 and the (N+1)th head 11 is thereby increased).

In this case, the principal control means is only used for the (N−1)th head 11 and the (N+1)th head 11 so as to select the central ejecting direction among the five ejecting directions. Whereas, for the Nth head 11, the auxiliary control means is used in addition to the principal control means so as to eject ink droplets. The example in FIG. 6 shows that ink droplets are ejected in the second ejecting direction from the right in the drawing.

In such a manner, for the head 11 having the mounting position manufactured substantially as designed, the principal control means is used so as to eject ink droplets. Whereas, for the head 11 having the positional displacement relative to other heads 11, by changing the ejecting direction of ink droplets with the auxiliary control means, the landing position is adjusted to agree with that of the head 11 manufactured as designed.

As shown in FIG. 6, the space between the landing positions of ink droplets ejected from the liquid ejection parts of each head 11 can be thereby made constant substantially the liquid ejection parts of each head 11.

Figure 7:
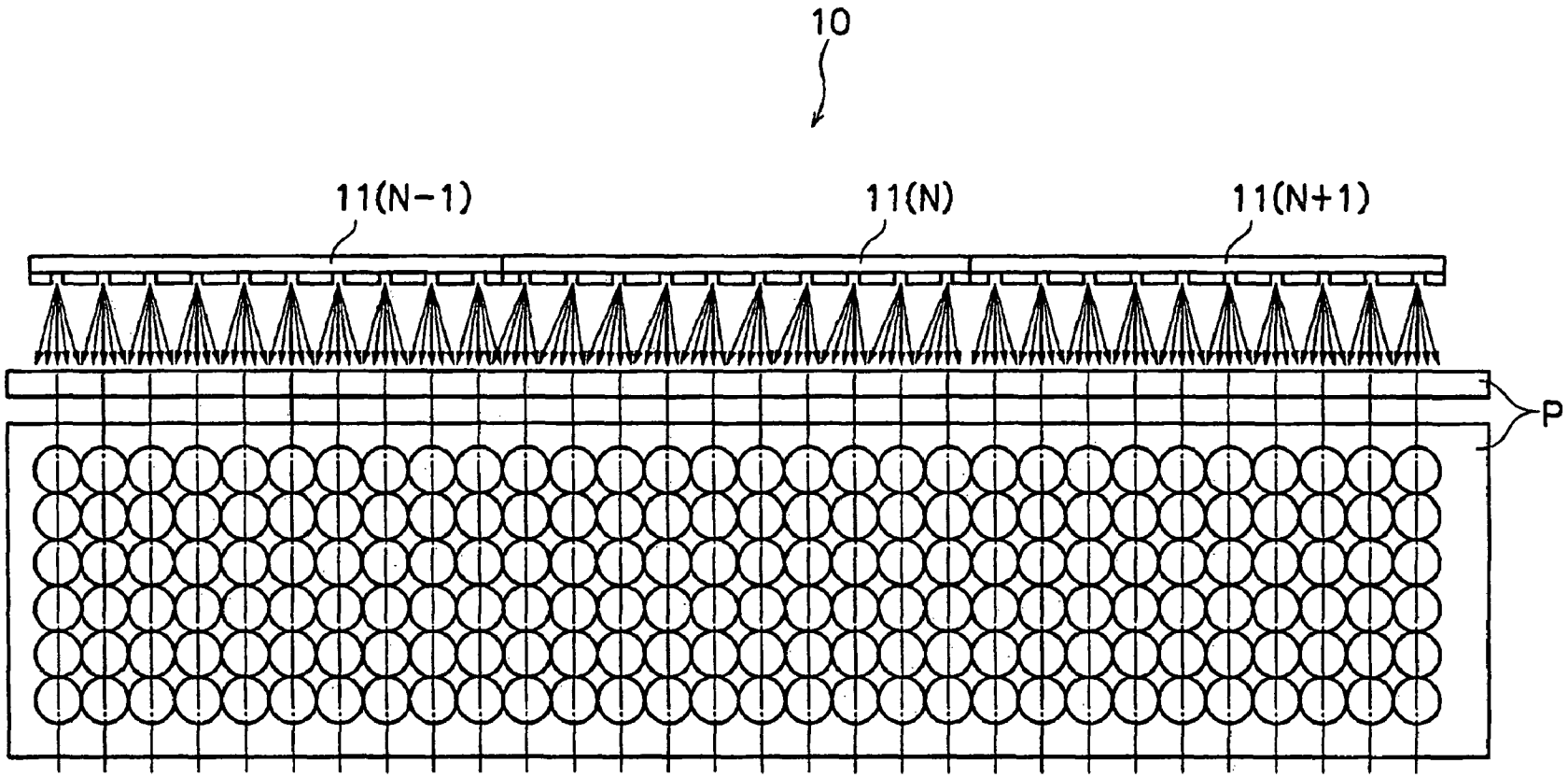
FIG. 7 is a drawing of an example in that landing positions of ink droplets are corrected by the principal control means, the auxiliary control means, and the auxiliary control execution determining means.

FIG. 7 is a drawing of an example in that the landing position of ink droplets is corrected by the principal control means, the auxiliary control means, and the auxiliary control execution determining means in the same way as in FIG. 6.

In FIG. 7, although the arrangement space between the heads 11 is constant differently from that in FIG. 6, an example is shown in that the ejecting direction of the Nth head 11 is different from other heads 11 due to the dispersion in ejection characteristics for each head 11. The example in FIG. 7 shows that the ejecting direction of the Nth head 11 is deflected in the left.

In this case, if by using only the principal control means, ink droplets are ejected for the entire heads 11, while from the (N−1)th head 11 and the (N+1)th head 11, ink droplets are ejected in a substantially normal direction to the surface of the photographic paper P, from the Nth head 11, ink droplets are ejected in a direction deflected in the left.

Hence, as shown in FIG. 7, the Nth head 11 is controlled to eject ink droplets in the second ejecting direction from the right in the drawing using the auxiliary control means together with the principal control means.

(Reference-Direction Setting Means)

According to the embodiment, the head 11 in a second mode includes reference-direction setting means in addition to the ejecting-direction changing means described above.

The reference-direction setting means is for individually setting for each head 11 one reference principal direction among a plurality of ejecting directions of ink droplets due to the ejecting-direction changing means.

In this case, in the same way as in the above-description, by the ejecting-direction changing means, each head 11 is also formed to be able to eject ink droplets in five different directions as shown in FIG. 6, for example.

Then, the reference-direction setting means first sets up the central ejecting direction among the five ejecting directions as the principal direction.

Next, in the same way as in the above-description, by printing a test pattern, and the presence of the head 11 having the landing positional displacement more than a predetermined value is detected. If such a head 11 is detected, the principal direction is changed relative to other heads 11 in accordance with the detected result.

As shown in FIG. 6 for example, it is assumed that the Nth head 11 have the landing positional displacement more than a predetermined value. At this time, when the second ejecting direction from the right in the drawing is set for the Nth head 11 as the principle direction, the landing positional displacement can be adjusted. This is the same as in FIG. 7.

In addition, in FIGS. 6 and 7, the principal direction is set at a direction closest to the normal direction to the photographic paper P; however, it is not necessarily to be set in such a manner.

For example, if many heads 11 (majority) are displaced in ejecting directions to the left in the drawing as the Nth head 11 shown in FIG. 7, the central ejecting direction is set at the principal direction among the five ejecting directions as the principal direction of the Nth head 11. For other heads 11, such as the (N−1)th head 11 and the (N+1)th head 11 shown in FIG. 7, the second ejecting direction from the left is set at the principal direction.

Setting in such a manner can make the landing pitch of ink droplets substantially constant for the entire heads 11. In this case, the principal direction of the head 11 is not set at a direction closest to the normal direction to the photographic paper P; however, there is no problem.

(Ejecting-Angle Setting Means)

Furthermore, according to the embodiment, the head 11 in a third mode includes ejecting-angle setting means in addition to the ejecting-direction changing means described above.

The ejecting-angle setting means is for individually setting for each head 11 the ejecting direction of ink droplets due to the ejecting-direction changing means.

Figure 8:
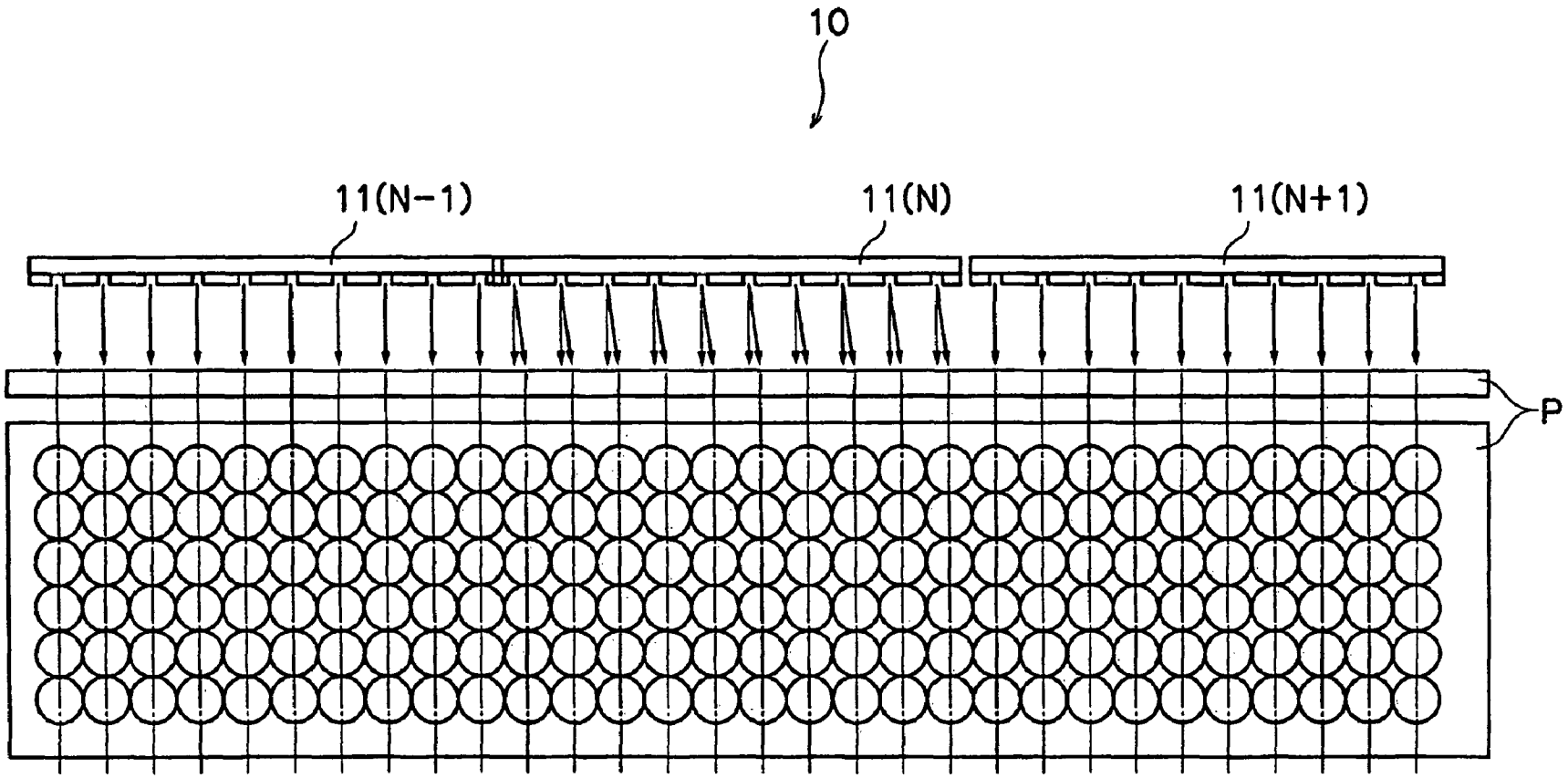
FIG. 8 is a drawing of an example in that landing positions of ink droplets are corrected by ejection direction changing means and ejecting angle setting means.

FIG. 8 is a drawing of an example in that the landing position of ink droplets is corrected by the ejecting-direction changing means and the ejecting-angle setting means.

FIG. 8 shows an example in that among the heads 11, the Nth head 11 is arranged closer to the (N−1)th head 11, so that the space between the Nth head 11 and the (N−1)th head 11 is reduced (the space between the Nth head 11 and the (N+1)th head 11 is thereby increased).

In this case, if ink droplets are ejected from each head 11 as they are (for the Nth head 11, ink droplets are ejected in arrow directions shown by thin lines), the landing space is reduced between the ink droplets ejected from the right-most liquid ejection part in the drawing of the (N−1)th head 11 and the ink droplets ejected from the left-most liquid ejection part in the drawing of the Nth head 11.

Hence, in this case, the ejecting-angle setting means of the heads 11 other than the Nth head 11 controls ink droplets at ejected without changing the ejecting angle whereas, the ejecting-angle setting means of the Nth head 11 entirely shifts the ejecting angle of ink droplets to the right by the predetermined angle so as to set the ejecting angle so as to eject ink droplets in arrow directions shown by heavy lines in the drawing. Thereby, the landing pitch of ink droplets for the entire heads 11 can be made substantially constant, so that the landing positional displacement of ink droplets becomes inconspicuous.

Figure 9:
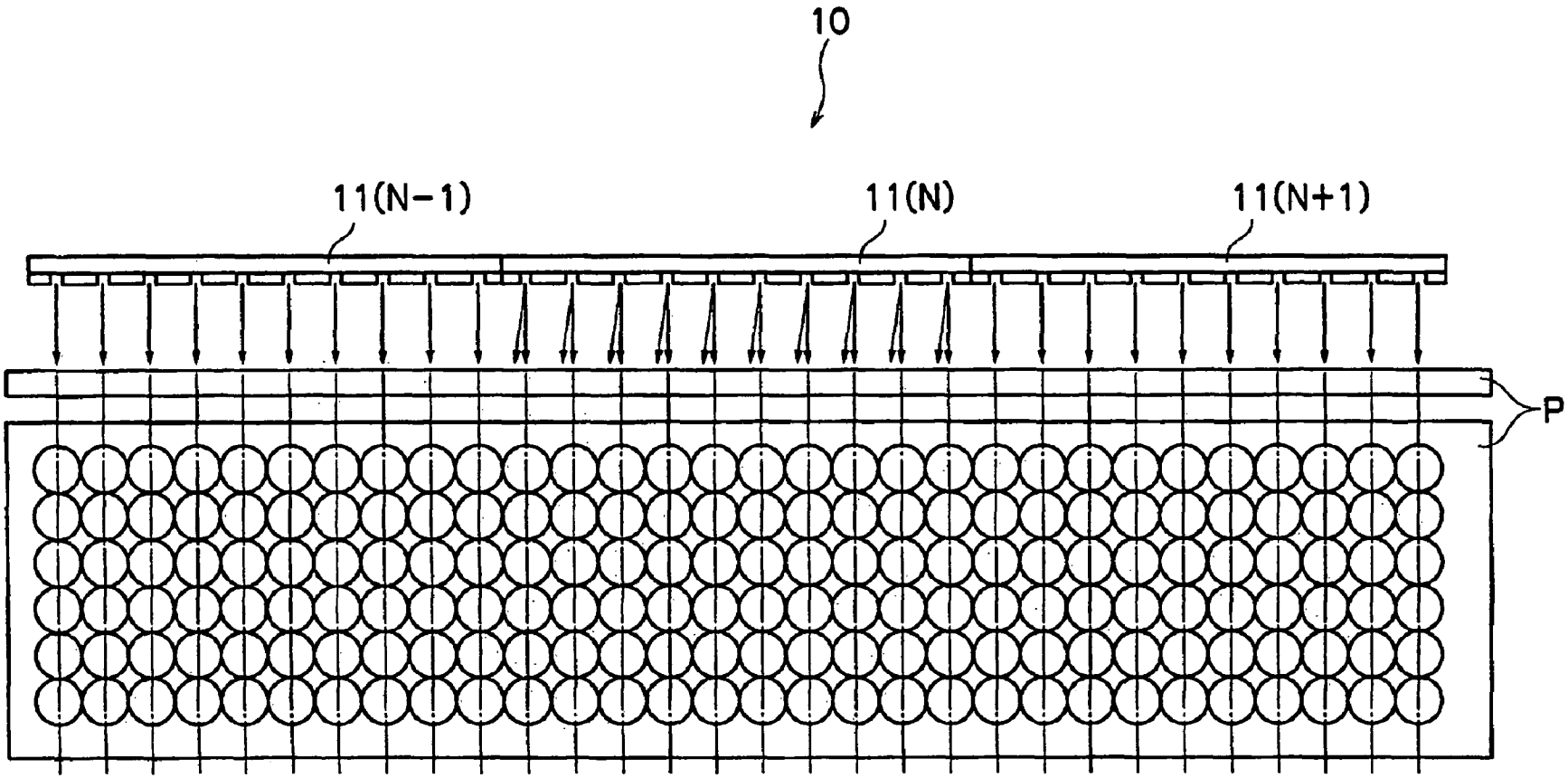
FIG. 9 is a drawing of another example in that landing positions of ink droplets are corrected by the ejection direction changing means and the ejecting angle setting means.

FIG. 9 shows another example in that the landing position of ink droplets is corrected by the ejecting-direction changing means and the ejecting-angle setting means.

In FIG. 9, although the arrangement space between the heads 11 is constant differently from that in FIG. 8, an example is shown in that the ejecting direction of the Nth head 11 is different from other heads 11 due to the dispersion in ejection characteristics for each head 11. This example shows that the ejecting direction (arrow direction shown by the thin line) of the Nth head 11 is deflected in the left.

In this case in the same way as in FIG. 8, the ejecting-angle setting means of the Nth head 11 entirely shifts the ejecting angle of ink droplets to the right by the predetermined angle so as to eject ink droplets in a substantially normal direction to the photographic paper P.

Figure 10A:
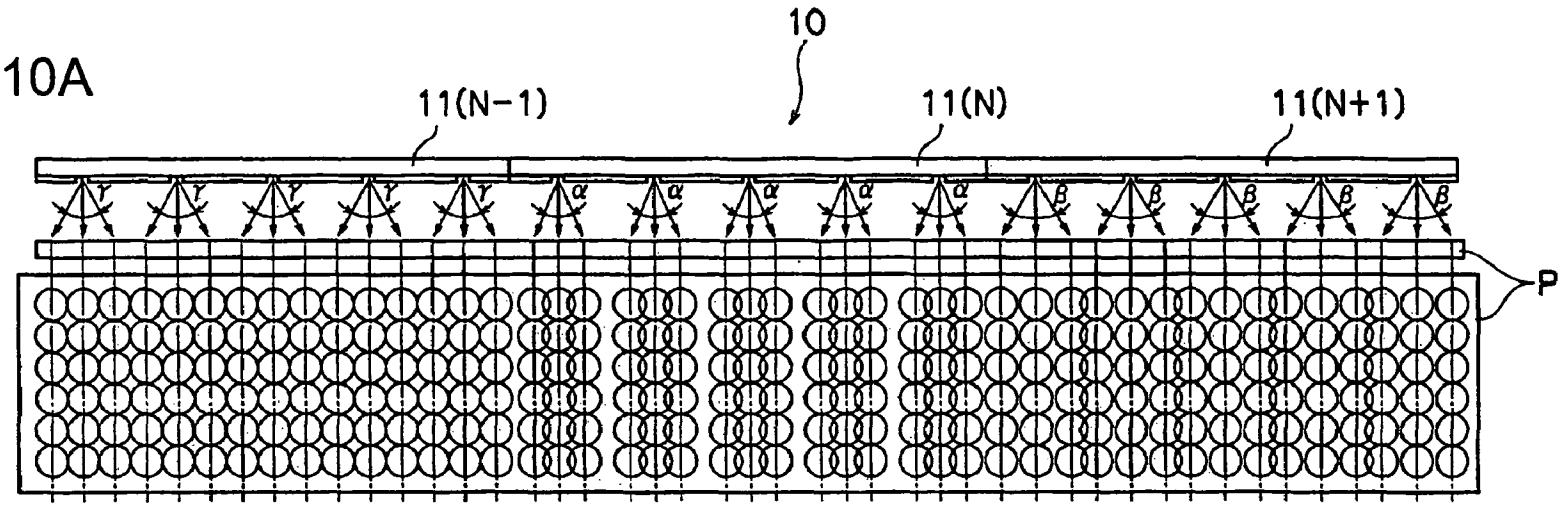
FIGS. 10A and 10B are drawings of another example of the ejecting angle setting means.
Figure 10B:
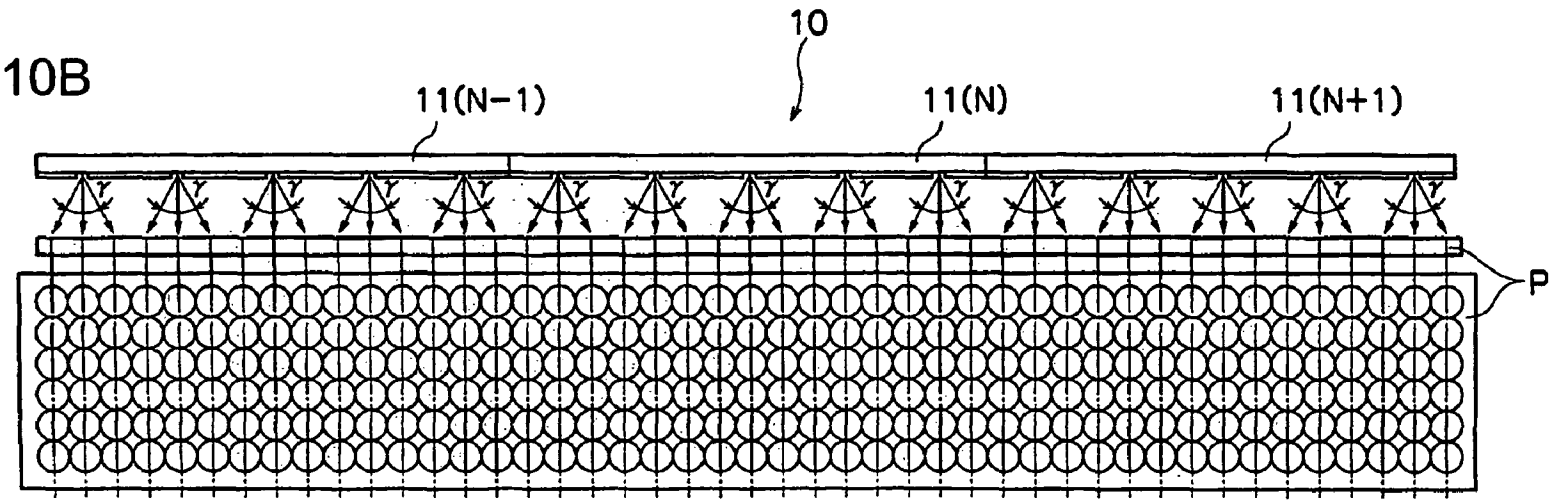

FIGS. 10A and 10B are drawings showing another example of the ejecting-angle setting means. In FIG. 10A, it is assume that while each head 11 can eject ink droplets in a plurality of ejecting directions, when the central ejecting direction is selected, the entire heads 11 can eject ink droplets in a substantially normal direction to the photographic paper P.

Moreover, in the liquid ejection parts of each head 11, among a plurality of ejecting directions, the angle defined by the left-most ejecting direction in the drawing and the right-most ejecting direction is set at an angle $\gamma$. At this time, it is assumed that while the ejecting angle of the (N−1)th head 11 be the angle $\gamma$ as designed, the ejecting angle of the Nth head 11 be the angle $\alpha$ ($<\gamma$) and the ejecting angle of the (N+1)th head 11 be the angle $\beta$ ($>\gamma$).

When a maximum ejecting angle is different in such a manner, the Nth head 11 is set to increase the maximum ejecting angle (from the angle $\alpha$ to the angle $\gamma$). Similarly, the (N+1)th head 11 is set to reduce the maximum ejecting angle (from the angle $\beta$ to the angle $\gamma$).

Thereby, as shown in FIG. 10B, the entire heads 11 including the Nth head 11 and the (N+1)th head 11 can be set to have the maximum ejecting angle $\gamma$.

By adjusting the maximum ejecting angle in such a manner, the landing position can be corrected to the range in that it cannot be corrected otherwise than with changing the ejecting angle.

Furthermore, according to the embodiment, the head 11 in a fourth mode includes the ejecting-angle setting means and the reference-direction setting means in addition to the ejecting-direction changing means described above.

That is, for each head 11, while the ejecting angle of ink droplets is individually set by the ejecting-angle setting means, one reference principal direction is individually set by the reference-direction setting means among a plurality of ejecting directions of ink droplets.

For example, each head 11 is set at able to eject ink droplets in a plurality of ejecting directions. Among the plurality of ejecting directions, the angle defined by the left-most ejection direction and the right-most ejecting direction (maximum deflection angle) is assumed at the angle $\gamma$ in the same way as the above.

In this case, if it is assumed to have no landing positional displacement in the Nth head 11, for example, while the ejecting-angle setting means of the Nth head 11 maintains the maximum deflection angle at the angle $\gamma$, the reference-direction setting means sets up the central ejection direction among a plurality of ejection directions as the principal direction.

Whereas, it is assumed to have a landing positional displacement in the (N+1)th head 11. At this time, while the ejecting-angle setting means of the (N+1)th head 11 sets up the maximum deflection angle at an angle other than the angle $\gamma$, the reference-direction setting means sets up any one of directions among a plurality of ejection directions as the principal direction. The landing position of ink droplets ejected from the (N+1)th head 11 can agree with that from the Nth head 11 in such a manner.

When the ejecting angle is changed relative to other heads 11 as well as the reference principal direction is set at an optimum direction, as described above, the landing positional displacement can be corrected.

(First Ejection Control Means)

Furthermore, according to the embodiment, using the head 11 including the ejecting-direction changing means or the principal control means and the auxiliary control means, and the reference-direction setting means or the ejecting-angle setting means, the ink droplets ejection is controlled by first ejection control means as follows.

The first ejection control means is the means that at least part of the liquid ejection part, using the ejecting-direction changing means, controls liquid-droplet ejection so as to form one pixel line or one pixel using at least two different liquid ejection parts arranged in the vicinity by means of ejecting ink droplets in different directions from at least two different liquid ejection parts arranged in the vicinity so as to land ink droplets on the same pixel line or by means of landing ink droplets on the same pixel region so as to form a pixel.

According to the present invention, the first ejection control means in a first mode makes the ejection direction of ink droplets ejected from each nozzle 18 variable in $2^J$ different even-numbered directions with a J-bit control signal (J: positive integer), while sets up the space between the two landing positions of ink droplets being remotest from each other among $2^J$ directions to be about $(2^J-1)$ times that between the two nozzles 18 adjacent to each other. Then, when ink droplets are ejected from the nozzle 18, any one of the $2^J$ directions is selected.

Alternatively, the first ejection control means in a second mode makes the ejection direction of ink droplets ejected from each nozzle 18 variable in $(2^J+1)$ different odd-numbered directions with a (J+1)-bit control signal (J: positive integer), while sets up the space between the two landing positions of ink droplets being remotest from each other among $(2^J+1)$ directions to be about $2^J$ times that between the two nozzles 18 adjacent to each other. Then, when ink droplets are ejected from the nozzle 18, any one of the $(2^J+1)$ directions is selected.

For example, in the first mode, if it is assumed to use a 2-bit control signal (J=2), the number of ejection directions is $2^J=4$ (even-numbered). The space between the two landing positions of ink droplets being remotest from each other among $2^J$ directions is about three times that of the two nozzles 18 adjacent to each other ($(2^J-1)=3$).

In this example, if three-fold of the space between the nozzles 18 adjacent to each other (42.3 μm) when the resolution of the head 11 is 600 DPI, i.e. 126.9 μm, is assumed to the distance between two dots being remotest from each other during deflecting by the first ejection control means, the deflection angle θ° is:

$$\tan 2\theta=126.9/2000\approx 0.0635, \text{ then}$$

$$\theta\approx 1.8°.$$

In the second mode, if it is assumed to use a 3-bit control signal (J=2), the number of ejection directions is $2^J+1=5$ (odd-numbered). The space between the two landing positions of ink droplets being remotest from each other among $(2^J+1)$ directions is four times that of the two nozzles 18 adjacent to each other ($2^J=4$).

Figure 11:
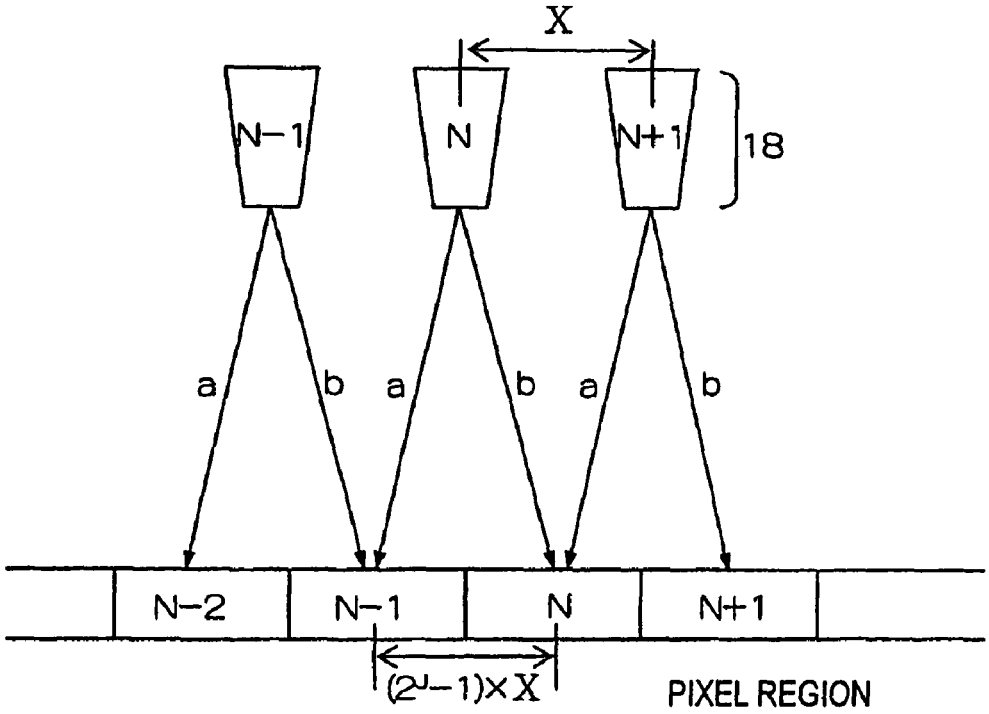
FIG. 11 is a drawing of an example in that ink droplets are landed on one pixel from liquid ejection parts adjacent to each other, respectively, which is set as even-numbered ejection directions.

FIG. 11 is a drawing more specifically showing the ejection directions of ink droplets when using a one-bit control signal (J=1) in the first mode. In the first mode, the ejection directions of ink droplets can be set in a bilateral symmetry in the arranging direction of the nozzles 18.

When the space between the two ($2^J=2$) landing positions of ink droplets being remotest from each other is set to be one-fold ($(2^J-1)=1$) of that of the two nozzles 18 adjacent to each other, as shown in FIG. 11, on one pixel region, ink droplets can be landed from the respective nozzles 18 of liquid ejection parts being adjacent to each other. That is, as shown in FIG. 11, the distance between pixel regions being adjacent to each other is $(2^J-1)\times X$ ($(2^J-1)\times X=X$, in the example shown in FIG. 11), where the space between the nozzles 18 is denoted as X.

In this case, the landing positions of ink droplets are located between the nozzles 18.

Figure 12:
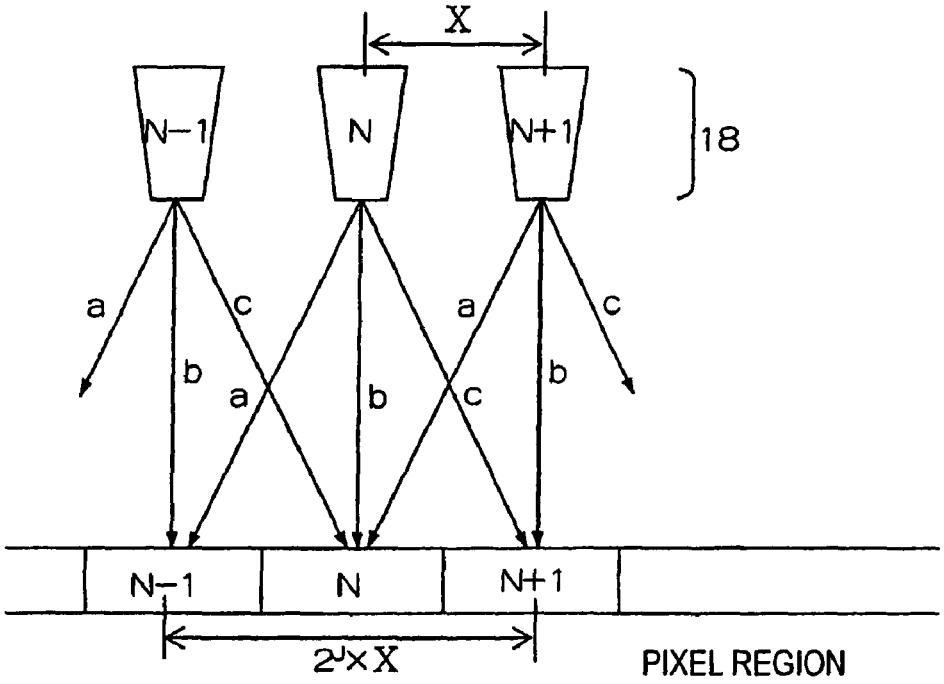
FIG. 12 is a drawing of an example in that odd-numbered ejection directions are established from deflection ejection of ink droplets in both bilateral symmetric directions and a perpendicularly downward direction.

FIG. 12 is a drawing more specifically showing the ejection directions of ink droplets when using a two-bit control signal (J=1) in the second mode. In the second mode, the ejection directions of ink droplets from the nozzles 18 can be set to have odd-numbered directions. That is, while in the first mode, the ejection directions of ink droplets can be set to have bilateral symmetric even-numbered directions in the arranging direction of the nozzles 18, further using a +one-bit control signal, ink droplets can be ejected just underneath from the nozzles 18. Hence, by both the ejection of ink droplets in bilateral symmetric directions (ejection in a direction and c direction shown in FIG. 12) and the ejection just underneath (ejection in b direction shown in FIG. 12), the ejection can be set to have odd-numbered directions.

In the example shown in FIG. 12, the control signal has two bits so that the ejection has three $(2^J+1)$ different odd-numbered directions. Among three $(2^J+1)$ ejection directions, the space between two landing positions being remotest from each other is set up to be about two-fold ($2^J$) that (X in FIG. 12) between two nozzles 18 being adjacent to each other ($2^J\times X$, in FIG. 12), and when ink droplets are ejected, any one of three $(2^J+1)$ ejection directions is selected.

Thereby, as shown in FIG. 12, in addition to a pixel region N positioned just underneath a nozzle N, ink droplets can also be landed on a pixel region (N−1) and a pixel region (N+1) positioned on both sides of the pixel region N.

The landing positions of ink droplets oppose the nozzles 18.

As described above, by a manner of using the control signal, at least two liquid ejection parts (the nozzles 18) located in the vicinity can land ink droplets on at least one identical pixel region. When the pitch of liquid ejection parts in their arranging direction is especially x as shown in FIGS. 11 and 12, each liquid ejection part can eject ink droplets at positions of $\pm(\frac{1}{2}\times X)\times P$(P: positive integer) about the center of its own liquid ejection part in the arranging direction of liquid ejection parts.

Figure 13:
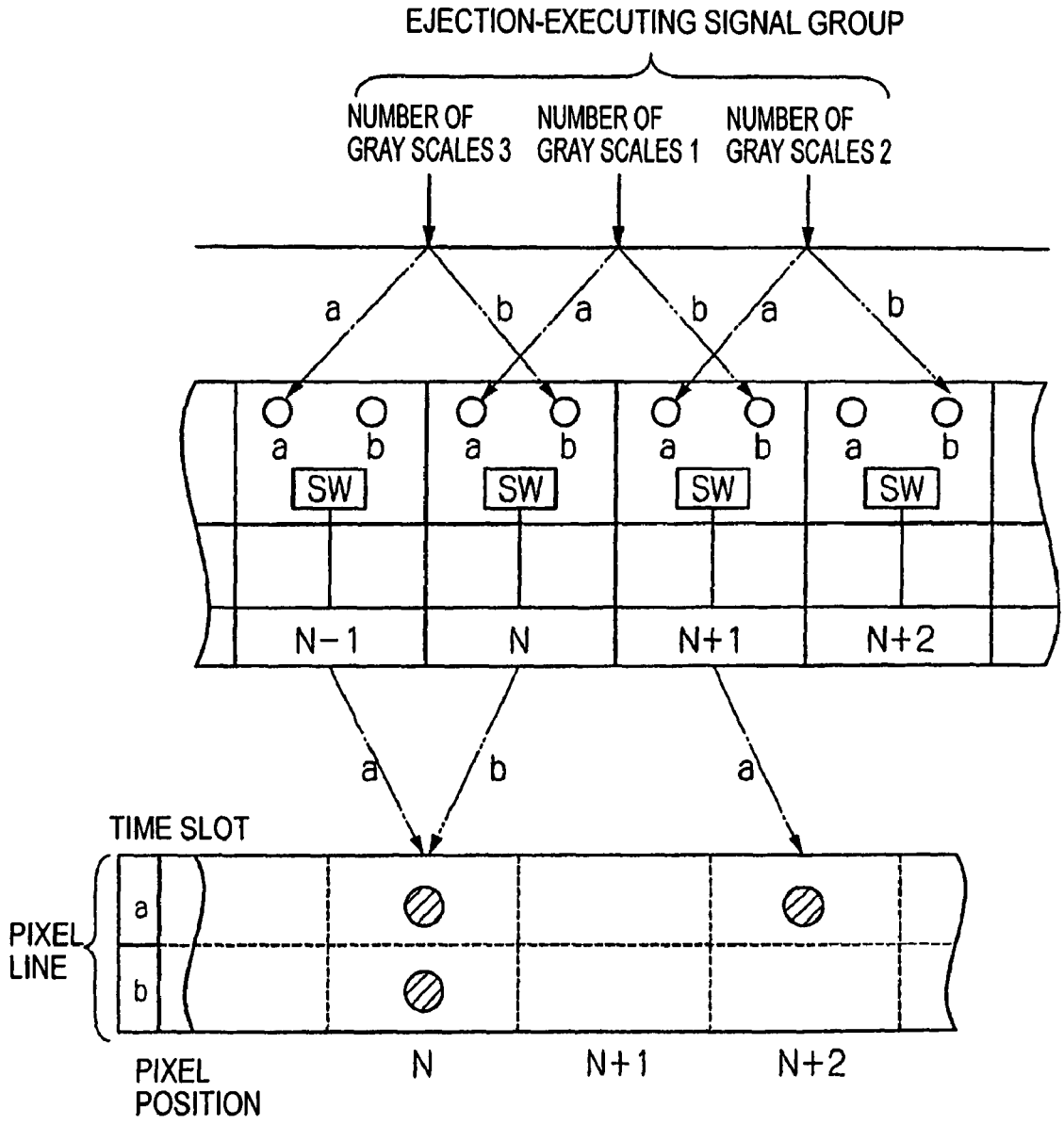
FIG. 13 is a drawing showing a process forming each pixel on photographic paper with liquid ejection parts based on an ejection execution signal in the case of two-way ejection (even-numbered ejection directions).

FIG. 13 is a drawing for illustrating a pixel forming method (bidirectional ejection) using a one-bit control signal (J=1) in the first mode (ink droplets can be ejected in different even-numbered directions) of the first ejection control means.

FIG. 13 shows the procedure forming each pixel on photographic paper by a liquid ejection part with ejection execution signals fed in parallel to the head 11. The ejection execution signal corresponds to an image signal. In the example of FIG. 13, the number of gray scales of the ejection execution signal of a pixel N is 3; the number of gray scales of the ejection execution signal of a pixel (N+1) is 1; and the number of gray scales of the ejection execution signal of a pixel (N+2) is 2.

The ejection signal of each pixel is fed to a predetermined liquid ejection part at cycles a and b while from each liquid ejection part, ink droplets are ejected at the cycles a and b. The cycles a and b correspond to time slots a and b. A plurality of dots, which correspond to the number of gray scales of the ejection execution signal, are formed within one pixel region at cycles a and b. For example, at the cycle a, the ejection signal of the pixel N is fed to the liquid ejection part (N−1) and the ejection signal of the pixel (N+2) is fed to the liquid ejection part (N+1).

Then, from the liquid ejection part (N−1), ink droplets are ejected with deflection in a direction a so as to land at the position of the pixel N on the photographic paper. Also, from the liquid ejection part (N+1), ink droplets are ejected with deflection in the direction a so as to land at the position of the pixel (N+2) on the photographic paper.

The ink droplets corresponding to the number of gray scales 2 are thereby landed at each pixel position on the photographic paper at the time slot a. Since the number of gray scales of the ejection execution signal of the pixel (N+2) is 2, the pixel (N+2) is thereby formed. A similar procedure is repeated by the time slot b.

As a result, the pixel N is composed of the number (two), corresponding to the number of gray scales 3, of dots.

Thereby, at any of the number of gray scales, on a pixel region corresponding to one pixel number, ink droplets are not landed continuously (twice in a row) from the same liquid ejection part for forming a pixel, so that dispersion for every liquid ejection parts can be made inconspicuous. Also, if the ejection amount of ink droplets from any one of liquid ejection parts is insufficient, for example, dispersion in an occupied area with dots of each pixel can be reduced.

Furthermore, when a pixel composed of one, two, or more dots in an Mth pixel line and a pixel composed of one, two, or more dots in an (M+1)th pixel line are aligned along substantially the same line, for example, it is preferable to control that the liquid ejection part used for forming the pixel in the Mth pixel line or used for ejecting first ink droplets for forming the pixel in the Mth pixel line be different from the liquid ejection part used for forming the pixel in the (M+1)th pixel line or used for ejecting first ink droplets for forming the pixel in the (M+1)th pixel line.

Thereby, when a pixel is formed of one dot (2-step gradation), for example, pixels (dots) formed by the same liquid ejection part cannot be aligned along the same line. Alternatively, when a pixel is formed with the small number of dots, the liquid ejection parts used for ejecting first ink droplets for forming the pixel cannot be always identical along the same line.

Thereby, when pixels composed of one dot are arranged along substantially the same line, for example, if ink droplets are not ejected from the liquid ejection part for forming the pixel resulting from plugging, etc., the pixel would not be formed all through in this pixel line if the same liquid ejection part were used. However, by adopting the above-method, such a problem can be solved.

Other than the above-mentioned method, a liquid ejection part may also be selected at random. Also, it may be preferable that the liquid ejection part used for forming the pixel in the Mth pixel line or used for ejecting first ink droplets for forming the pixel in the Mth pixel line be always different from the liquid ejection part used for forming the pixel in the (M+1)th pixel line or used for ejecting first ink droplets for forming the pixel in the (M+1)th pixel line.

Figure 14:
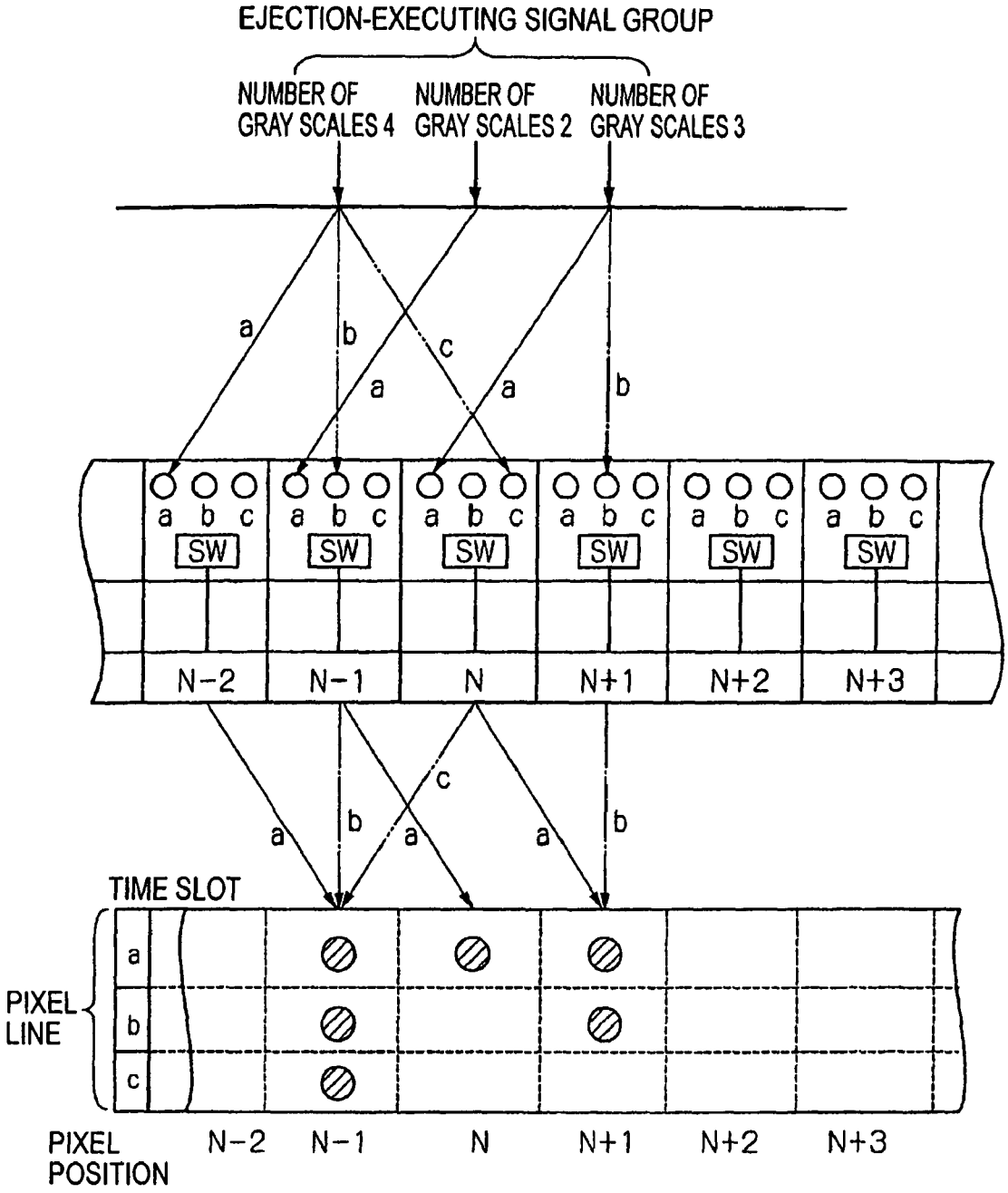
FIG. 14 is a drawing showing a process forming each pixel on photographic paper with liquid ejection parts based on an ejection execution signal in the case of three-way ejection (odd-numbered ejection directions).

Furthermore, FIG. 14 is a drawing for illustrating a pixel forming method (tri-directional ejection) using a two-bit control signal (J=1) in the second mode (ink droplets can be ejected in different odd-numbered directions) of the first ejection control means.

The forming process of the pixel shown in FIG. 14 is the same as that in FIG. 13 described above, so that the description is omitted. In such a manner, also in the second mode, the ink-droplet ejection can be controlled so as to form one pixel line or one pixel using at least two different liquid ejection parts located in the vicinity in the same way as in the first mode using the first ejection control means.

(Second Ejection Control Means)

Moreover, according to the embodiment, using the head 11 including the ejecting-direction changing means, or the principal control means and the auxiliary control means, the reference-direction setting means, and the ejecting-angle setting means, the following ejection control of ink droplets is carried out by second ejection control means.

The second ejection control means is ink-droplet ejection control means in that when ink droplets are landed on a pixel region, for every ink-droplet ejection from a liquid ejection part, any one of M different landing positions (M: integers of 2 or more), at least part of which is included within the pixel region, is determined as a landing position (precisely, target landing position) of ink droplets in the arranging direction of liquid ejection parts in the pixel region so that the ejection is controlled so as to land the ink droplets at the determined position.

In particular, according to the embodiment, the second ejection control means determines any one of M different landing positions at random (irregularly or without regularity). Among various determining methods at random, there is a method for determining any one of M different landing positions using a random number generator, example.

Also, according to the embodiment, the M landing positions are allotted at the space that is about 1/M of the arranging pitch of liquid ejection parts (the nozzles 18).

Figure 15:
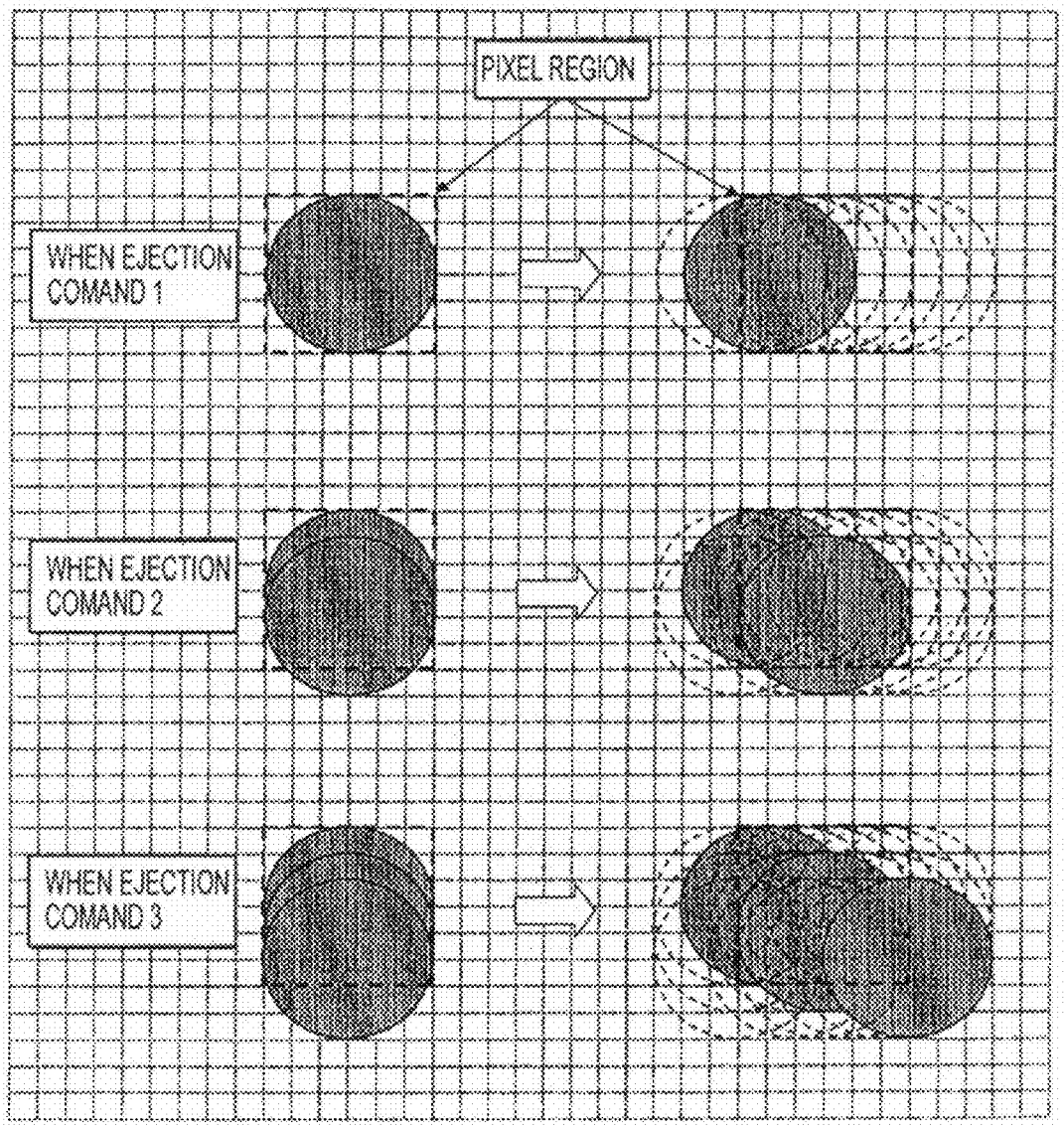
FIG. 15 includes plan views showing a state in that ink droplets are landed at any one position of M different landing positions on one pixel region.

FIG. 15 is a plan view of a state in that ink droplets are landed at any one of the M different landing positions on one pixel region, comparatively showing conventional landing states (left in the drawing) and the landing states according to the embodiment (right in the drawing). In FIG. 15, square regions surrounded by broken lines are pixel regions. Also circular regions are landed ink droplets (dots).

First, when an ejection command is 1 (two-step gradation), in a conventional printing, ink droplets are landed on the pixel region so that the ink droplets are substantially included within the pixel region (in FIG. 15, the size of landed ink droplets is denoted by the size inscribed in the pixel region).

Whereas, according to the embodiment, ink droplets are landed at any one of the M different landing positions in the arranging direction of the nozzles 18. In the example of FIG. 15, a state is shown in that ink droplets are landed at one determined position among M (8) landing positions on one pixel region (7 different landing positions are substantially shown because one of 8 positions corresponds to no landing) (in the drawing, circles shown by solid lines denote the position where ink droplets are landed in practice while circles shown by broken lines denote other landing positions). In this example where the ejection command is 1, the second position from the left in the drawing is determined, and a state that ink droplets are landed at the determined position is shown.

When the ejection command is 2, ink droplets are further landed on the pixel region one on top of the other. In the example of FIG. 15, in the pixel region, a state displaced downward by one scale unit is shown in view of feeding of photographic paper.

When the ejection command is 2, in a conventional method, second ink droplets are landed on substantially the same line (with no displacement in a lateral direction) as that of the ink droplets landed at first.

Whereas, according to the embodiment, as described above, first ink droplets are landed at the position determined at random; further second ink droplets are also landed at the position determined at random regardless of the first landing position (independently of the first ink droplets). In the example of FIG. 15, a state is shown in that the second ink droplets are landed at the center of the pixel region in a lateral direction.

Furthermore, the way when the ejection command is 3 is the same as that when the ejection command is 2 described above. In a conventional method, three droplets are landed with no displacement in a lateral direction. However, according to the embodiment, third ink droplets are also landed at the position determined regardless of the first and the second landing position.

When ink droplets are landed in such a manner, in overlaying dots in pile so as to form a pixel, stripes due to dispersion in characteristics of liquid ejection parts can be eliminated, so that the dispersion would not be noticed.

That is, the regularity in landing positions of ink droplets is eliminated and each ink droplet (dot) is arranged at random, and hence the arrangement is microscopically non-uniform, but is rather uniform and isotropic macroscopically, so that the dispersion would not be noticed.

Accordingly, this configuration has an effect for masking the ink-droplet dispersion in characteristics of liquid ejection parts. If dots are not randomly arranged, the entire dots are arranged in a regular pattern, so that a portion disturbing the regularity is noticeable. In tittle in particular, color shading is expressed by an area ratio of a dot and a base (portion not covered with a dot); with increasing regularity of the leaving manner of the base, the dispersion becomes noticeable.

Whereas, when dots are randomly arranged without the regularity, the dispersion is difficult to be noticeable if the arrangement is slightly changed.

When a color line head is arranged by providing a plurality of the line heads 10 mentioned above so as to supply different color ink for each line head 10, the following effects can be obtained.

In a color ink-jet printer, when a plurality of ink droplets (dots) are overlaid so as to form a pixel, for preventing a moiré effect, landing positional accuracies are required more than those in a single color. However, as in this embodiment, when ink droplets are arranged at random, the moiré problem is not produced, resulting in a simple color dispersion. Accordingly, image degradation due to the moiré can be prevented.

In a serial system in that ink droplets are overlaid by driving the head several times in a principal scanning direction, the moiré is not a problem in particular; however, the moiré is a problem in a line system. Then, when a method for landing ink droplets at random as in the embodiment is employed, the moiré is difficult to be generated, enabling the line-system ink-jet printer to be easily achieved.

Furthermore, landing ink droplets at random extends the landing range of the ink droplets even the total amount of ink landed on photographic paper is the same, so that the drying time of the landed ink droplets can be reduced. Since the printing speed is larger (printing time is shorter) than that of the serial system especially in the line system, its effect is remarkable.

(Number of Pixels Increasing Means)

Moreover, according to the embodiment, using the head 11 including the ejecting-direction changing means or the principal control means and the auxiliary control means, and the reference-direction setting means or the ejecting-angle setting means, the resolution is controlled to increase by number of pixels increasing means.

The number of pixels increasing means is the means in that using the above-mentioned ejecting-direction changing means, ink droplets ejected from each liquid ejection part are controlled so as to land at two or more different positions in the arranging direction of liquid ejection parts, so that the number of pixels is increased more than that formed by landing ink droplets from each liquid ejection part at one position.

For example, when the space between the nozzles 18 adjacent to each other is 42.3 (μm), the physical resolution (in construction) of the head 11 is 600 DPI.

Whereas, when each nozzle 18 lands ink droplets at two positions in the arranging direction of liquid ejection parts using the number of pixels increasing means, the printing can be carried out with a resolution of 1200 DPI; further, when each nozzle 18 lands ink droplets at three positions in the arranging direction of liquid ejection parts, the printing can be carried out with a resolution of 1800 DPI.

Figure 16:
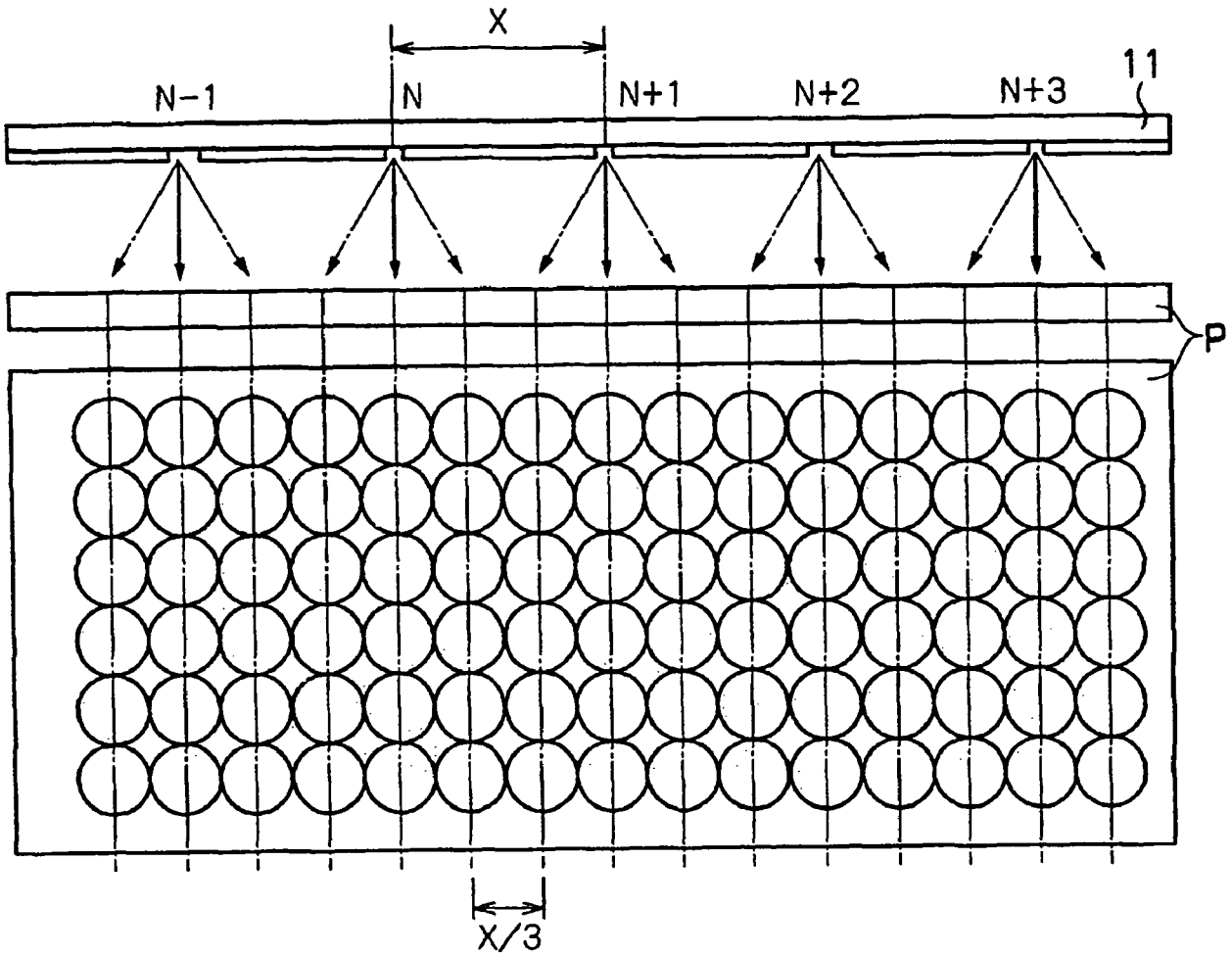
FIG. 16 is a drawing showing ejection directions of ink droplets using number of pixels increasing means.

FIG. 16 is a drawing specifically showing ejection directions of ink droplets using the number of pixels increasing means. As shown in FIG. 16, when the space between liquid ejection parts in the head 11 is X, from each liquid ejection part, ink droplets are assumed to be landed at three positions in equal intervals, respectively, in the arranging direction of liquid ejection parts. Furthermore, the space between the landing position when the Nth liquid ejection part ejects ink droplets in the right in the drawing and the landing position when the (N+1)th liquid ejection part ejects ink droplets in the left in the drawing is controlled so as to be X/3.

In such a manner, while from the respective liquid ejection parts, ink droplets are ejected in P different directions, a plurality of ink droplets ejected from each liquid ejection part are controlled to land at equal intervals in the arranging direction of liquid ejection parts, so that the printing can be carried out with a P-fold physical resolution (in construction) of the head 11.

The first ejection control means, the second ejection control means, and the number of pixels increasing means, which are described above, can be used in combination with the ejecting-direction changing means, the reference-direction setting means, and the ejecting-angle setting means as follows:

(1) The first ejection control means is provided in addition to the ejecting-direction changing means and the reference-direction setting means.

(2) The second ejection control means is provided in addition to the ejecting-direction changing means and the reference-direction setting means.

(3) The first ejection control means and the second ejection control means are provided in addition to the ejecting-direction changing means and the reference-direction setting means.

(4) The number of pixels increasing means is provided in addition to the ejecting-direction changing means and the reference-direction setting means.

(5) The first ejection control means and the number of pixels increasing means are provided in addition to the ejecting-direction changing means and the reference-direction setting means.

(6) The second ejection control means and the number of pixels increasing means are provided in addition to the ejecting-direction changing means and the reference-direction setting means.

(7) The first ejection control means, the second ejection control means, and the number of pixels increasing means are provided in addition to the ejecting-direction changing means and the reference-direction setting means.

(8) The first ejection control means is provided in addition to the ejecting-direction changing means and the ejecting-angle setting means.

(9) The second ejection control means is provided in addition to the ejecting-direction changing means and the ejecting-angle setting means.

(10) The first ejection control means and the second ejection control means are provided in addition to the ejecting-direction changing means and the ejecting-angle setting means.

(11) The number of pixels increasing means is provided in addition to the ejecting-direction changing means and the ejecting-angle setting means.

(12) The first ejection control means and the number of pixels increasing means are provided in addition to the ejecting-direction changing means and the ejecting-angle setting means.

(13) The second ejection control means and the number of pixels increasing means are provided in addition to the ejecting-direction changing means and the ejecting-angle setting means.

(14) The first ejection control means, the second ejection control means, and the number of pixels increasing means are provided in addition to the ejecting-direction changing means and the ejecting-angle setting means.

(15) The first ejection control means is provided in addition to the ejecting-direction changing means, the ejecting-angle setting means, and the reference-direction setting means.

(16) The second ejection control means is provided in addition to the ejecting-direction changing means, the ejecting-angle setting means, and the reference-direction setting means.

(17) The first ejection control means and the second ejection control means are provided in addition to the ejecting-direction changing means, the ejecting-angle setting means, and the reference-direction setting means.

(18) The number of pixels increasing means is provided in addition to the ejecting-direction changing means, the ejecting-angle setting means, and the reference-direction setting means.

(19) The first ejection control means and the number of pixels increasing means are provided in addition to the ejecting-direction changing means, the ejecting-angle setting means, and the reference-direction setting means.

(20) The second ejection control means and the number of pixels increasing means are provided in addition to the ejecting-direction changing means, the ejecting-angle setting means, and the reference-direction setting means.

(21) The first ejection control means, the second ejection control means, and the number of pixels increasing means are provided in addition to the ejecting-direction changing means, the ejecting-angle setting means, and the reference-direction setting means.

Among the above-combinations, some combinations will be specifically described.

Figure 17:
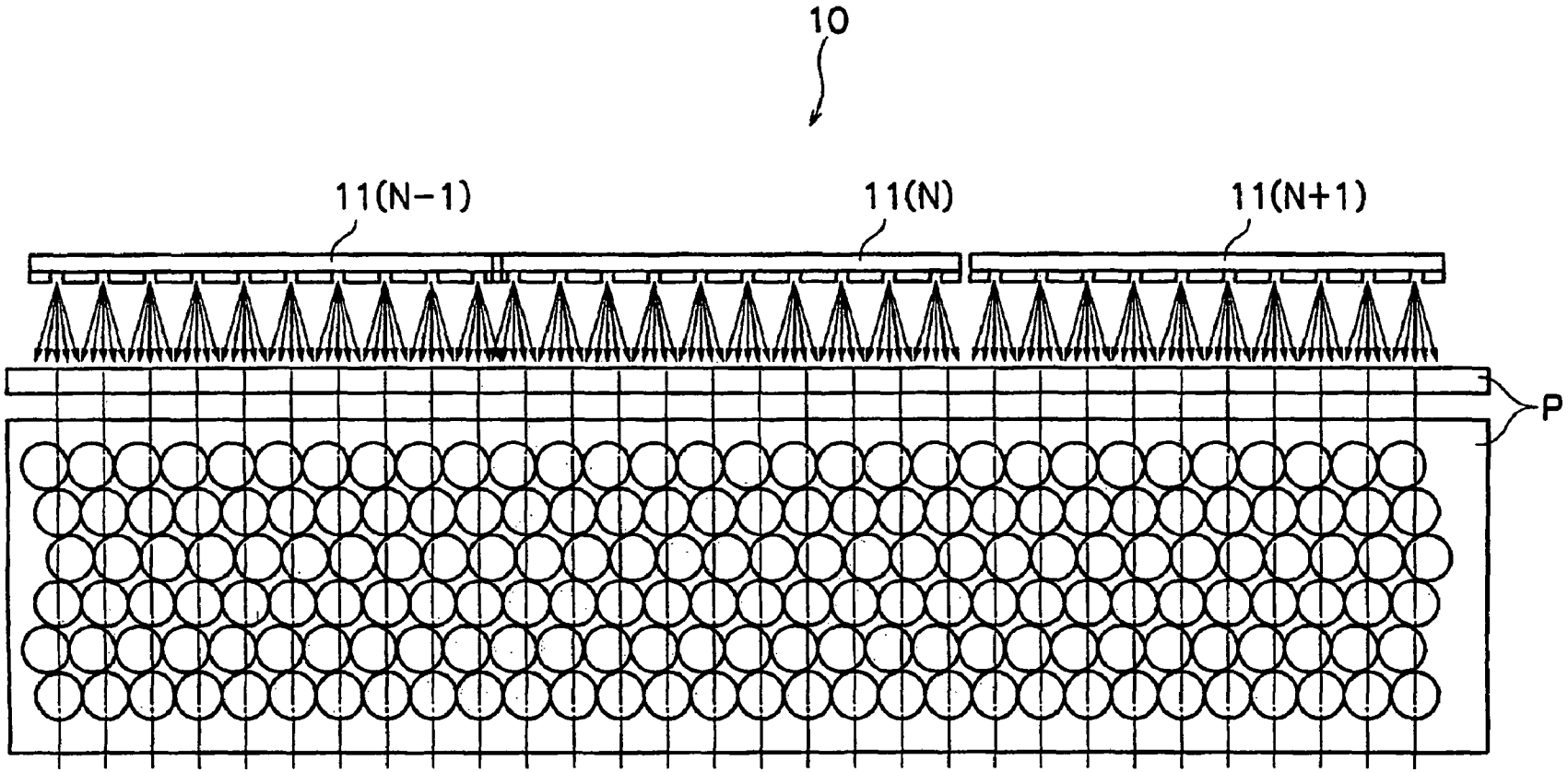
FIG. 17 is a drawing of an example having second ejection control means in addition to the ejection direction changing means and reference direction setting means.
Figure 18:
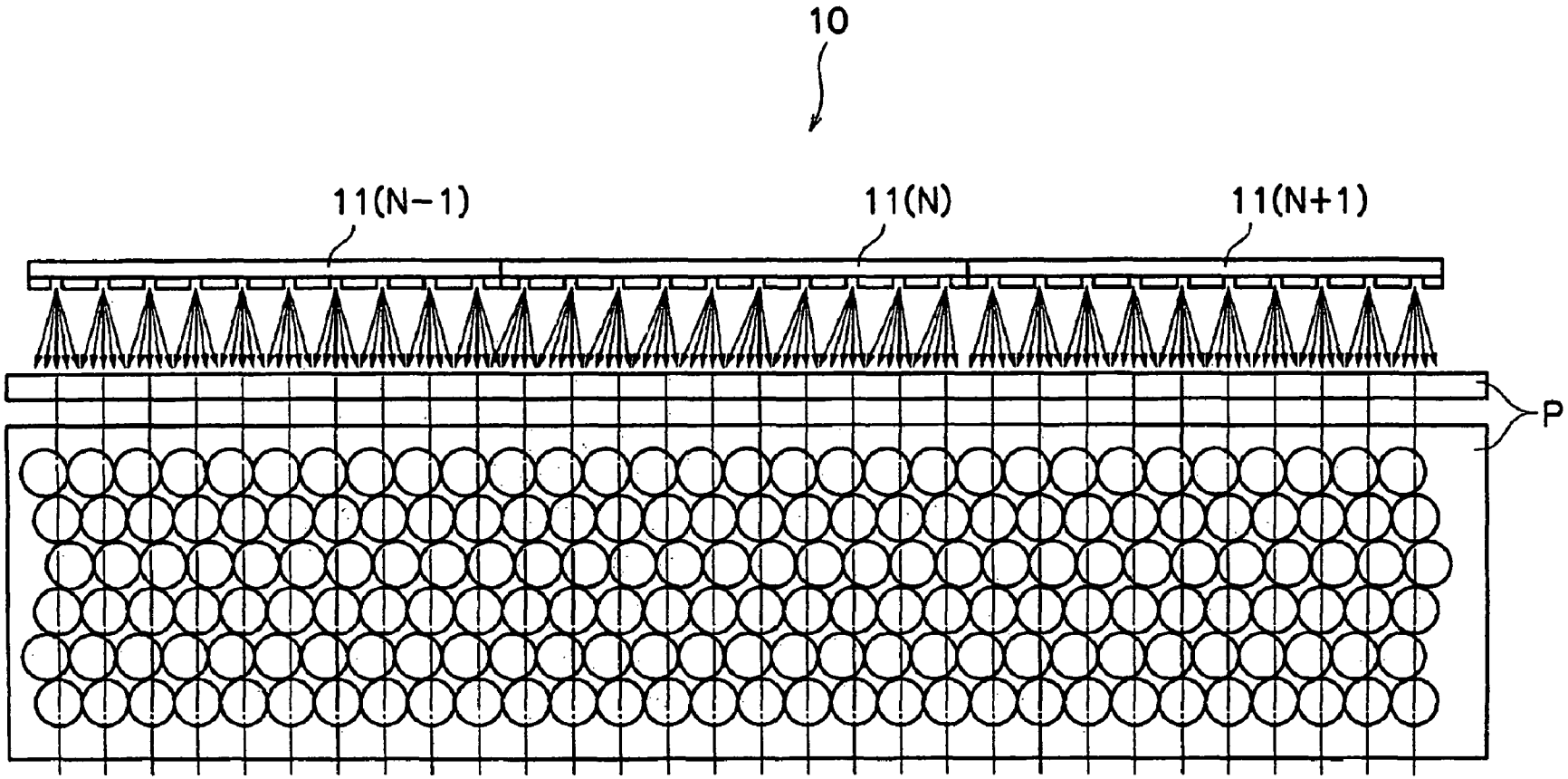
FIG. 18 is a drawing of an example having the second ejection control means in addition to the ejection direction changing means and the reference direction setting means.

FIGS. 17 and 18 are drawings showing an example of the combination item (2) in that the second ejection control means is provided in addition to the ejecting-direction changing means and the reference-direction setting means.

FIG. 17 herein shows an example in that the Nth head 11 is arranged close to the (N−1)th head 11; FIG. 18 shows an example in that the Nth head 11 has the ejection direction coming near the (N−1)th head 11.

In FIGS. 17 and 18, in the same way as in FIG. 6, while from each liquid ejection part of each head 11, ink droplets can be ejected in five different directions by the ejecting-direction changing means, one principal direction is established as a reference for each head 11 by the reference-direction setting means.

In the examples of FIGS. 17 and 18, while the central ejection direction is established as the principal direction for the (N−1)th head 11 and the (N+1)th head 11, for the Nth head 11, the second direction from the right is established as the principal direction. Furthermore, using the second ejection control means, the landing directions of ink droplets are assigned within the same pixel line at random for each pixel line.

Figure 19:
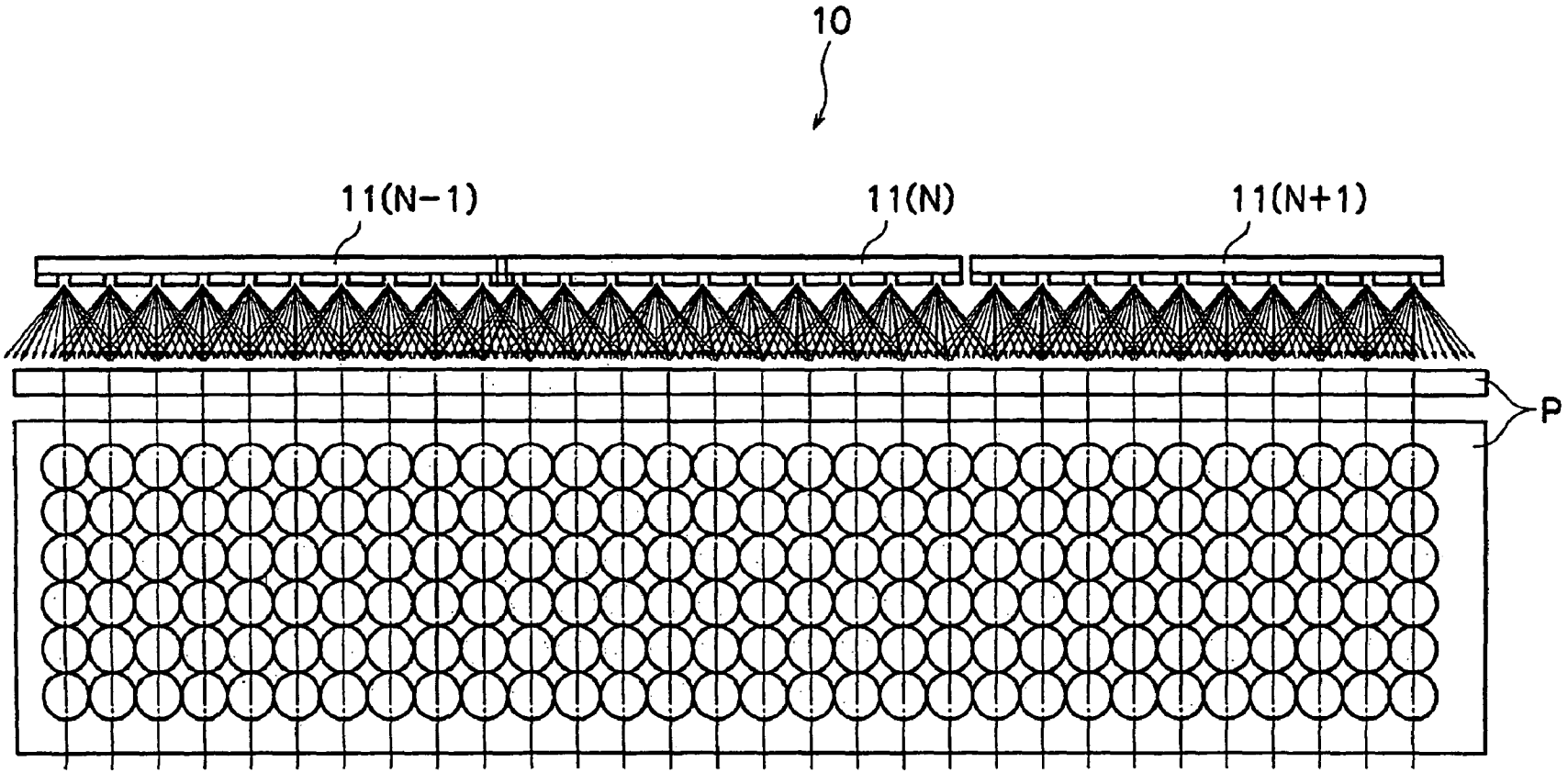
FIG. 19 is a drawing of an example having first ejection control means in addition to the ejection direction changing means and the reference direction setting means.
Figure 20:
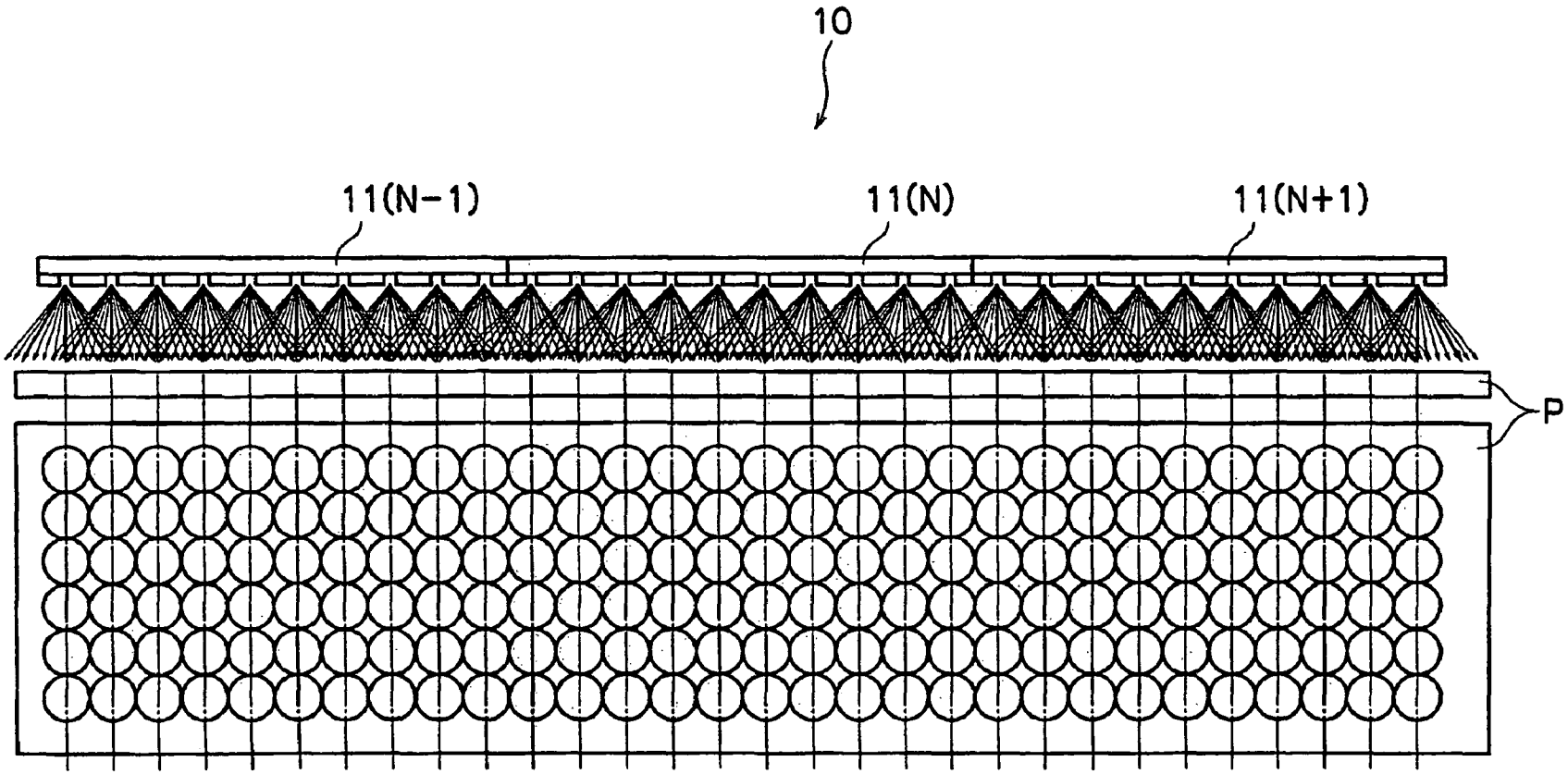
FIG. 20 is a drawing of an example having the first ejection control means in addition to the ejection direction changing means and the reference direction setting means.

FIGS. 19 and 20 are drawings showing an example of the combination item (1) in that the first ejection control means is provided in addition to the ejecting-direction changing means and the reference-direction setting means.

FIG. 19 herein shows an example in that the Nth head 11 is arranged close to the (N−1)th head 11; FIG. 20 shows an example in that the Nth head 11 has the ejection direction coming near the (N−1)th head 11.

In FIG. 19, from each liquid ejection part of each head 11, ink droplets are assumed that can be ejected in 13 different directions. In the (N−1)th head 11 and the (N+1)th head 11, the central ejection direction (the seventh direction from the left or right) is established as the principal direction by the reference-direction setting means. Furthermore, in each liquid ejection part, when ink droplets are landed on the pixel line located just underneath, the above-mentioned principal direction is selected as the ejection direction. Whereas when ink droplets are landed on the left pixel line in the drawing of the pixel line located just underneath, the third ejection direction from the left is selected. Also, when ink droplets are landed on the right pixel line in the drawing of the pixel line located just underneath, the third ejection direction from the right is selected. That is, in this example, the ejection direction is established such that ink droplets can be landed in the adjacent pixel line when the ejection direction is changed at four steps.

Furthermore, in the Nth head 11, the eighth ejection direction from the left (the sixth direction from the right) is established as the principal direction by the reference-direction setting means. Moreover, in each liquid ejection part, when ink droplets are landed on the pixel line located just underneath, the above-mentioned principal direction is selected as the ejection direction. Whereas when ink droplets are landed on the left pixel line in the drawing of the pixel line located just underneath, the fourth ejection direction from the left is selected as the ejection direction. Also, when ink droplets are landed on the right pixel line in the drawing of the pixel line located just underneath, the second ejection direction from the right is selected.

Then, the liquid ejection part of each head 11 lands ink droplets in the left pixel line in the drawing of the pixel line located just underneath at the first line. At the next second line, ink droplets are landed on the pixel line located just underneath. At the further third line, ink droplets are landed on the right pixel line in the drawing of the pixel line located just underneath.

Furthermore, at the next fourth line, the way is the same as that at the first line. In such a manner, ink droplets are sequentially landed so that the liquid ejection part of each head 11 lands ink droplets on the pixel line located just underneath as well as on the adjacent pixel lines on both sides thereof.

Figure 21:
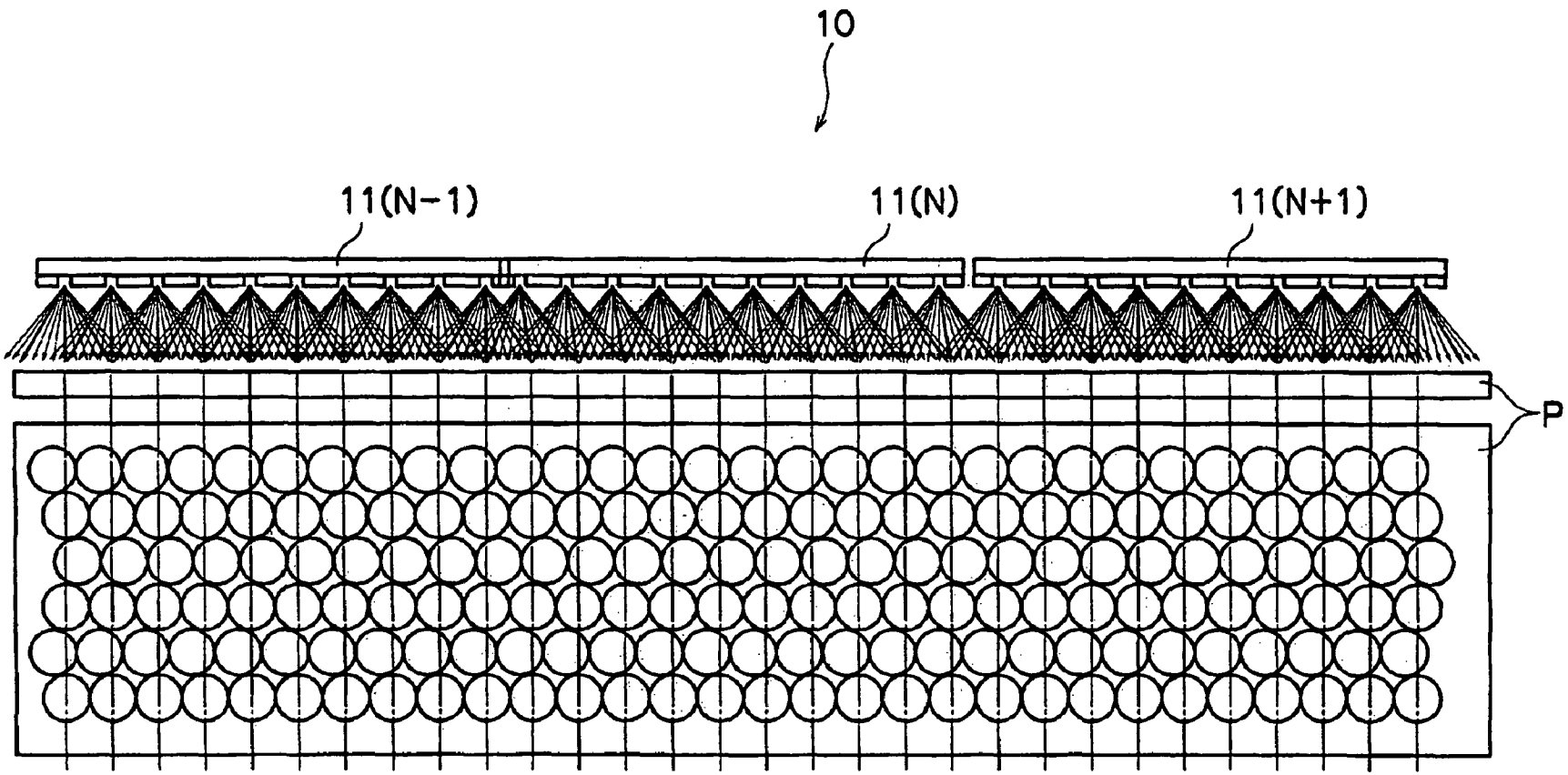
FIG. 21 is a drawing of an example having the first ejection control means and the second ejection control means in addition to the ejection direction changing means and the reference direction setting means.
Figure 22:
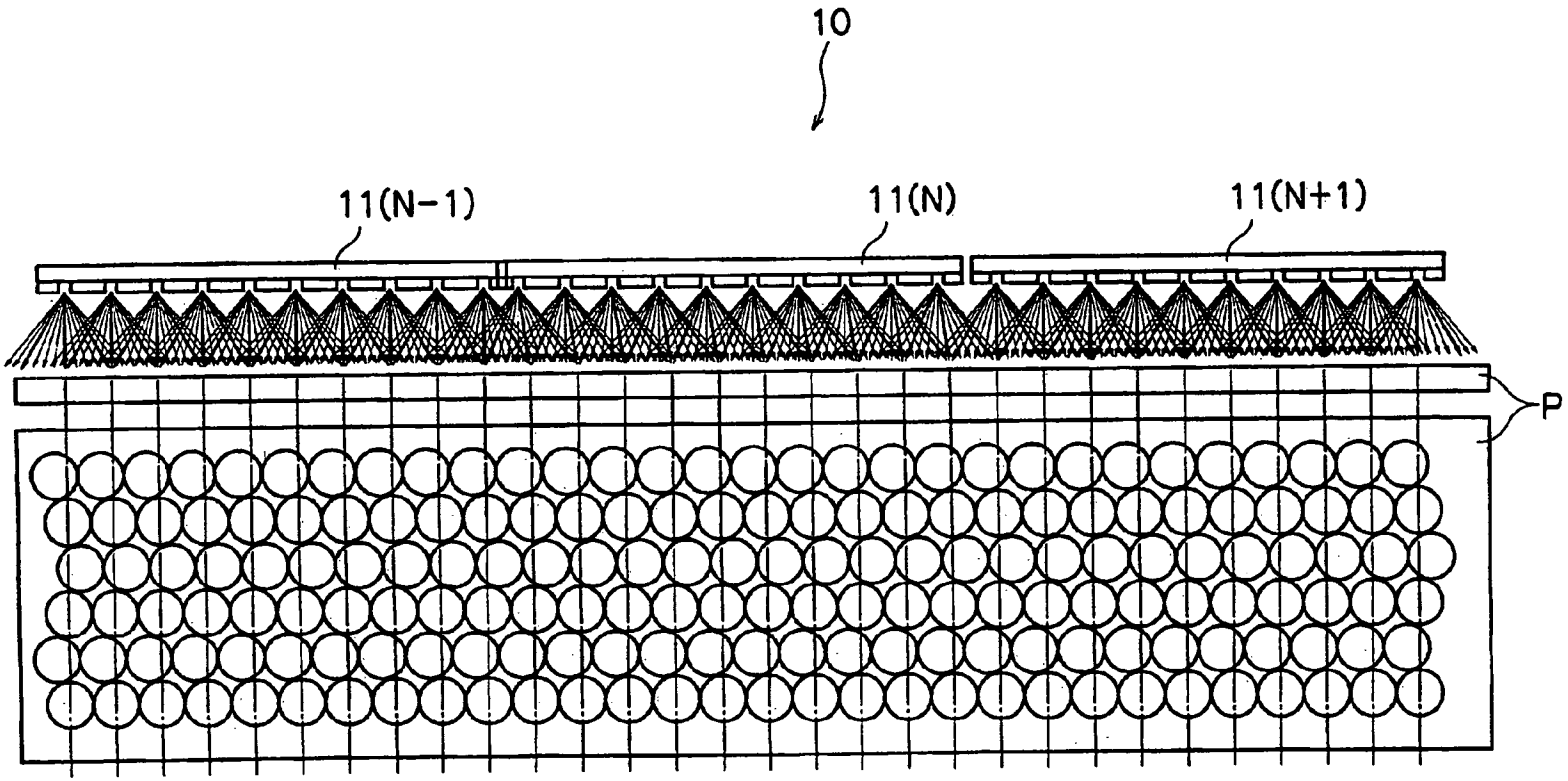
FIG. 22 is a drawing of an example having the first ejection control means and the second ejection control means in addition to the ejection direction changing means and the reference direction setting means.

FIGS. 21 and 22 are drawings showing an example of the combination item (3) in that the first ejection control means and the second ejection control means are provided in addition to the ejecting-direction changing means and the reference-direction setting means. That is, in FIGS. 21 and 22, landing positions are assigned at random within the same pixel region in addition to the examples of FIGS. 19 and 20, respectively.

Referring to FIGS. 21 and 22, in the (N−1)th head 11 and the (N+1)th head 11 for example, when from each liquid ejection part, ink droplets are landed on the pixel line located just underneath (principal direction), in addition to the central ejection direction (the seventh direction from the left, the principal direction), the sixth or eighth ejection direction from the left is selected at random. When ink droplets are landed on the left pixel line adjacent thereto, in addition to the third ejection direction from the left, the second or the forth ejection direction from the left is selected at random. Furthermore, when ink droplets are landed on the right pixel line adjacent to the pixel line located just underneath, in addition to the third ejection direction from the right, the second or the fourth ejection direction from the right is selected at random.

Similarly, in the Nth head 11, when ink droplets are landed on the pixel line located just underneath (principal direction), in addition to the sixth ejection direction from the right (principal direction), the fifth or the seventh ejection direction from the right is selected at random. When ink droplets are landed on the left pixel line adjacent thereto, in addition to the fourth ejection direction from the left, the third or the fifth ejection direction from the left is selected at random. Furthermore, when ink droplets are landed on the right pixel line adjacent to the pixel line located just underneath, in addition to the second ejection direction from the right, the first or the third ejection direction from the right is selected at random.

Figure 23A:
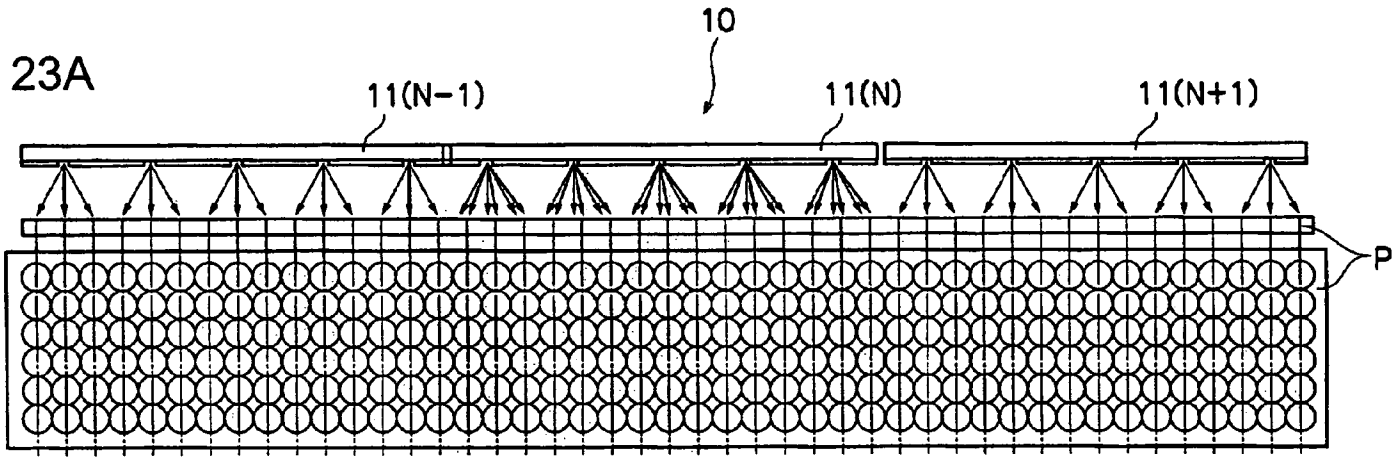
FIGS. 23A and 23B are drawings showing examples having the number of pixels increasing means in addition to the ejection direction changing means and the ejecting angle setting means.
Figure 23B:
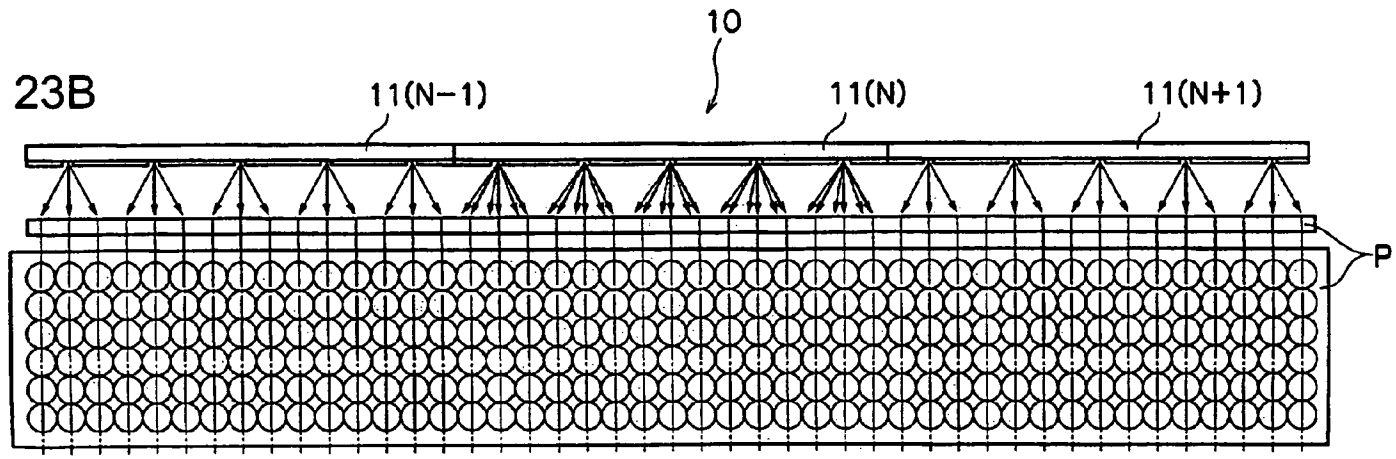

FIGS. 23A and 23B are drawings showing an example of the combination item (11) in that the number of pixels increasing means is provided in addition to the ejecting-direction changing means and the ejecting-angle setting means. FIG. 23A shows an example in that the Nth head 11 is arranged close to the (N−1)th head 11; FIG. 23B shows an example in that the Nth head 11 has the ejection direction coming near the (N−1)th head 11.

In the case of FIGS. 23A and 23B, in the same way as that in FIGS. 8 and 9, the ejecting-angle setting means of the heads 11 other than the Nth head 11 controls ink droplets to be ejected without changing the ejecting angle. Whereas, the ejecting-angle setting means of the Nth head 11 establishes ejecting angles so that ink droplets are ejected in arrow directions shown by heavy lines in the drawings by shifting ejecting angles of ink droplets together on the right by a predetermined angle.

Furthermore, by the number of pixels increasing means, each liquid ejection part of each head 11 lands ink droplets on the pixel line where ink droplets would be landed when no number of pixels increasing means is used as well as on the adjacent pixel lines on both sides thereof, respectively, so that dots are formed so as to have a three-fold resolution in construction of the head 11.

Figure 24A:
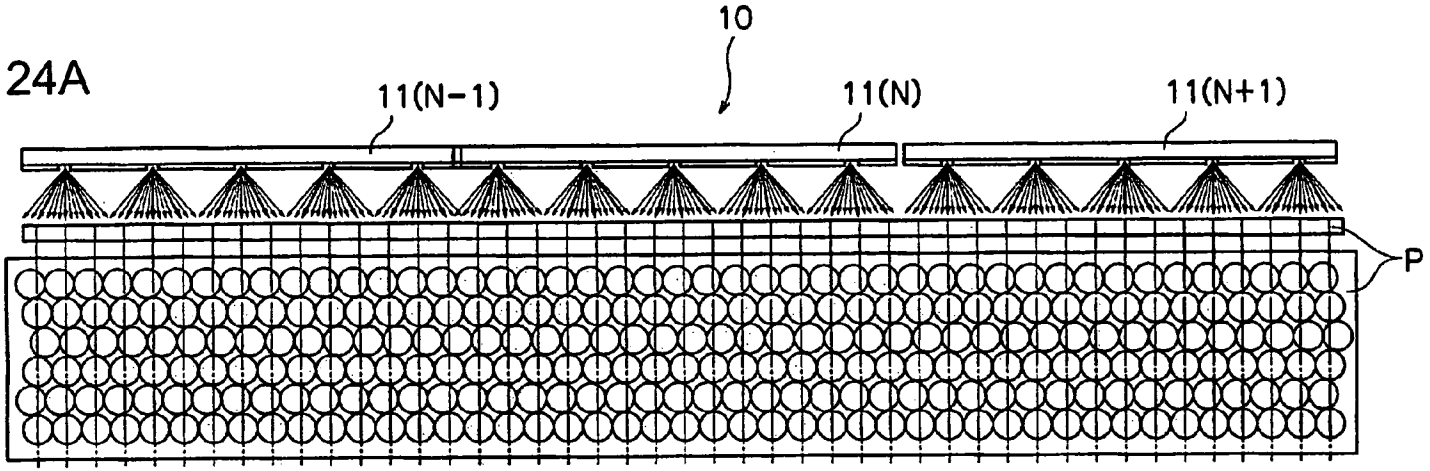
FIGS. 24A and 24B are drawings showing examples having the second ejection control means and the number of pixels increasing means in addition to the ejection direction changing means and the reference direction setting means.
Figure 24B:
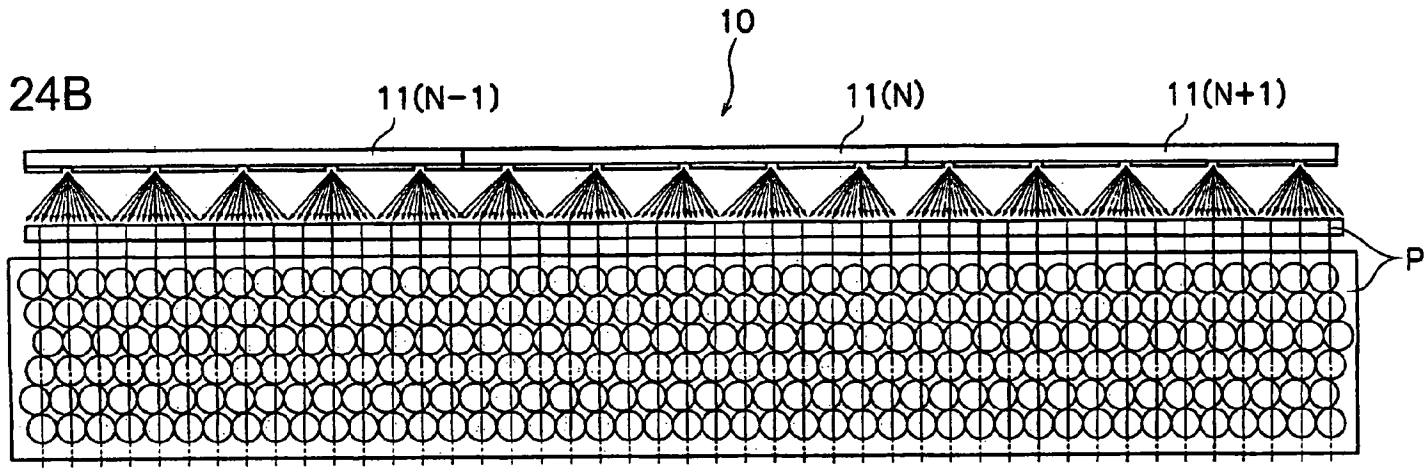

FIGS. 24A and 24B are drawings showing an example of the combination item (6) in that the second ejection control means and the number of pixels increasing means are provided in addition to the ejecting-direction changing means and the reference-direction setting means. FIG. 24A shows an example in that the Nth head 11 is arranged close to the (N−1)th head 11; FIG. 24B shows an example in that the Nth head 11 has the ejection direction coming near the (N−1)th head 11.

In FIG. 24A, for example, of FIGS. 24A and 24B, by the ejecting-direction changing means, while from each liquid ejection part of each head 11, ink droplets can be ejected in a plurality of different directions (13 directions in this example), one ejection direction is established for each head 11 as a reference principal direction. For example, for the (N−1)th head 11 and the (N+1)th head 11, the central ejection direction (the seventh direction from the left) is established as the principal direction. Furthermore, by the second ejection control means, in addition to the principal direction, any one of three ejection directions including the sixth and the eighth ejection direction from the left is selected at random.

Furthermore, by the number of pixels increasing means, when ink droplets are landed on the left pixel line adjacent thereto, in addition to the third ejection direction from the left, any one of three ejection directions including the second or the fourth ejection direction from the left is selected at random. Similarly, when ink droplets are landed on the right adjacent pixel line, in addition to the third ejection direction from the right, any one of three ejection directions including the second or the fourth ejection direction from the right is selected at random. In such a manner, by the number of pixels increasing means, while the resolution is increased, for each pixel line, landing positions of ink droplets are randomly assigned within the same pixel line.

Figure 25A:
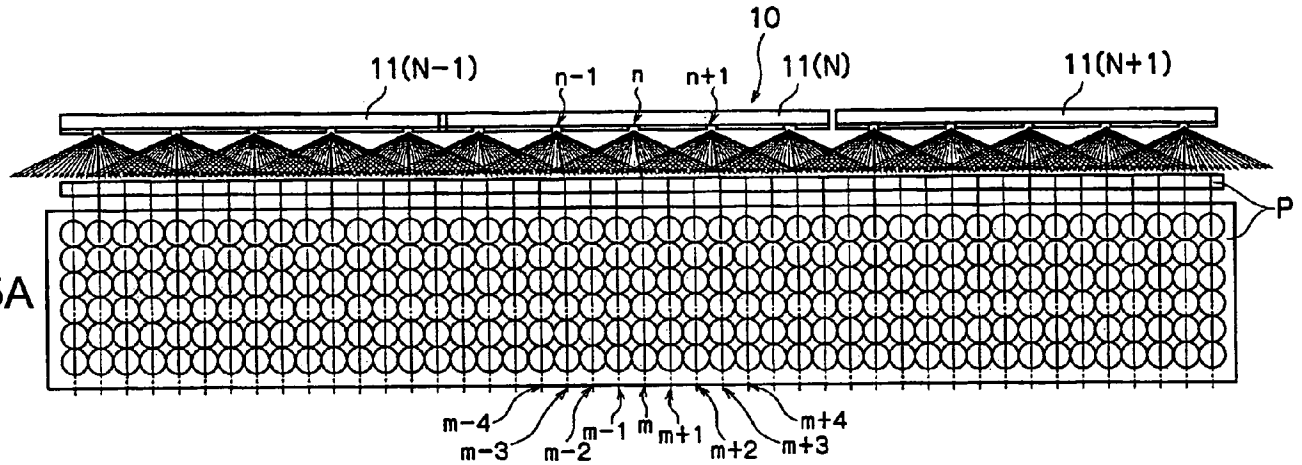
FIGS. 25A and 25B are drawings showing examples having the first ejection control means and the number of pixels increasing means in addition to the ejection direction changing means and the reference direction setting means.
Figure 25B:
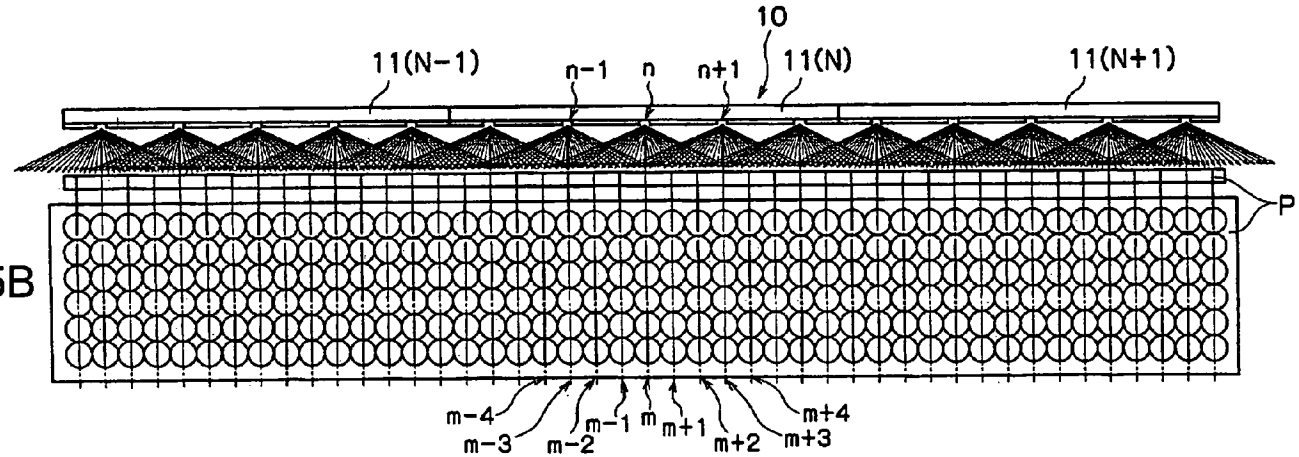

FIGS. 25A and 25B are drawings showing an example of the combination item (5) in that the first ejection control means and the number of pixels increasing means are provided in addition to the ejecting-direction changing means and the reference-direction setting means. FIG. 25A of FIGS. 25A and 25B shows an example in that the Nth head 11 is arranged close to the (N−1)th head 11; FIG. 24B shows an example in that the Nth head 11 has the ejection direction coming near the (N−1)th head 11.

In FIGS. 25A and 25B, by the number of pixels increasing means, each liquid ejection part of each head 11 lands ink droplets at three different positions so as to increase the resolution three times. For example, as shown in the Nth head 11, from the nth liquid ejection part, ink droplets are landed on pixel lines (m−1), m, and (m+1); from the (n+1)th liquid ejection part, ink droplets are landed on pixel lines (m+2), (m+3), and (m+4); and from the (n−1)th liquid ejection part, ink droplets are landed on pixel lines (m−4), (m−3), and (m−2).

In this case, by the first ejection control means, from the nth liquid ejection part, in addition to the above-mentioned three positions, ink droplets are landed on the pixel lines (m+2) and (m+3) as well as on the pixel lines (m−3) and (m−2).

By such a control, the first ejection control means and the number of pixels increasing means can be carried out simultaneously.

Figure 26A:
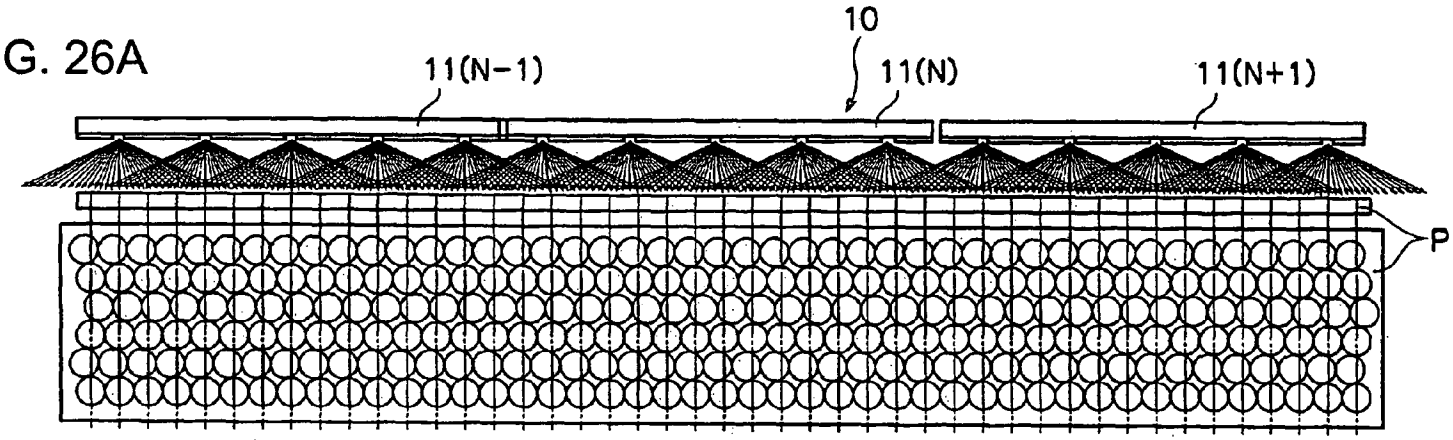
FIGS. 26A and 26B are drawings showing examples having the first ejection control means, the second ejection control means, and the number of pixels increasing means in addition to the ejection direction changing means and the reference direction setting means.
Figure 26B:
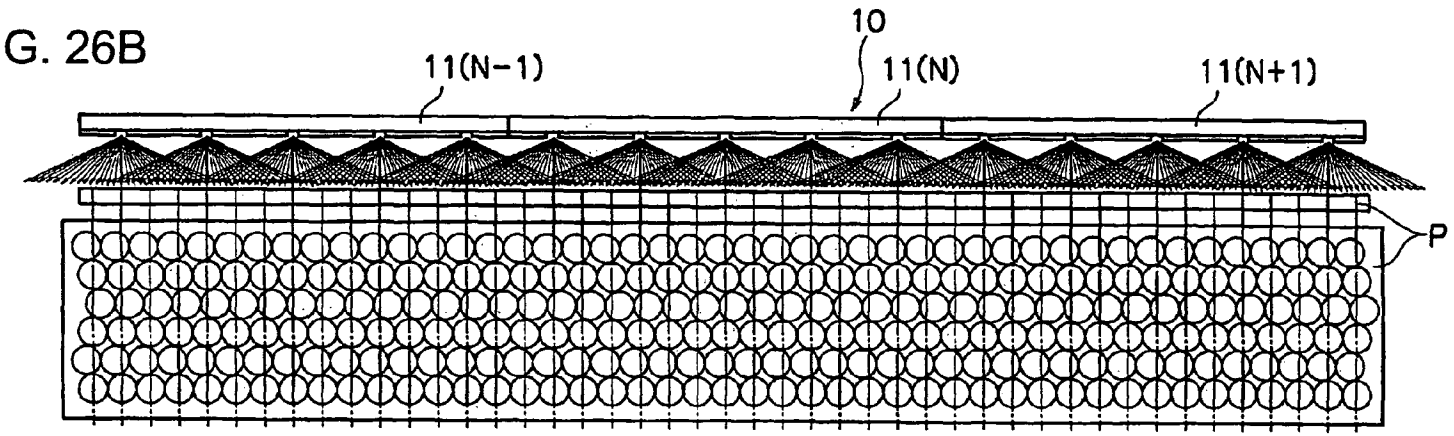

FIGS. 26A and 26B are drawings showing an example of the combination item (7) in that the first ejection control means, the second ejection control means, and the number of pixels increasing means are provided in addition to the ejecting-direction changing means and the reference-direction setting means. FIG. 26A of FIGS. 26A and 26B shows an example in that the Nth head 11 is arranged close to the (N−1)th head 11; FIG. 24B shows an example in that the Nth head 11 has the ejection direction coming near the (N−1)th head 11.

In FIGS. 26A and 26B, in addition to the example in FIGS. 25A and 25B, by the second ejection control means, landing positions of ink droplets are further assigned at random within the same pixel line. In the example of FIGS. 26A and 26B, any one of three ejection directions including ejection directions during landing of ink droplets in the example of FIGS. 25A and 25B and lateral directions on both sides thereof is selected at random.

Next, an ejection control circuit realizing the present embodiment will be described.

According to the embodiment, using the ejection control circuit, the ejecting-direction changing means controls the ejection direction of ink droplets to be ejected in at least two different directions by changing energy supply to the heating resistor 13. Also, the auxiliary control means controls ink droplets to be ejected in a direction different from that of the ink droplets ejected by the principal control means by supplying energy to the heating resistor 13 in a different way from that of the principal control means.

More specifically, while the two heating resistors 13 arranged within the ink chamber 12 are connected together in series, there is provided a circuit having a switching element (referred to as a current mirror circuit in the following description) connected between the heating resistors 13 connected in series. Through this circuit, electric current supplied to each heating resistor 13 is controlled by passing current between the heating resistors 13 or by discharging the current from between the heating resistors 13, so that the ejecting-direction changing means controls the ejection direction of ink droplets to be ejected in at least two different directions, or the auxiliary control means controls the ejection direction of ink droplets to be ejected in a direction different from that by the principal control means.

Figure 27:
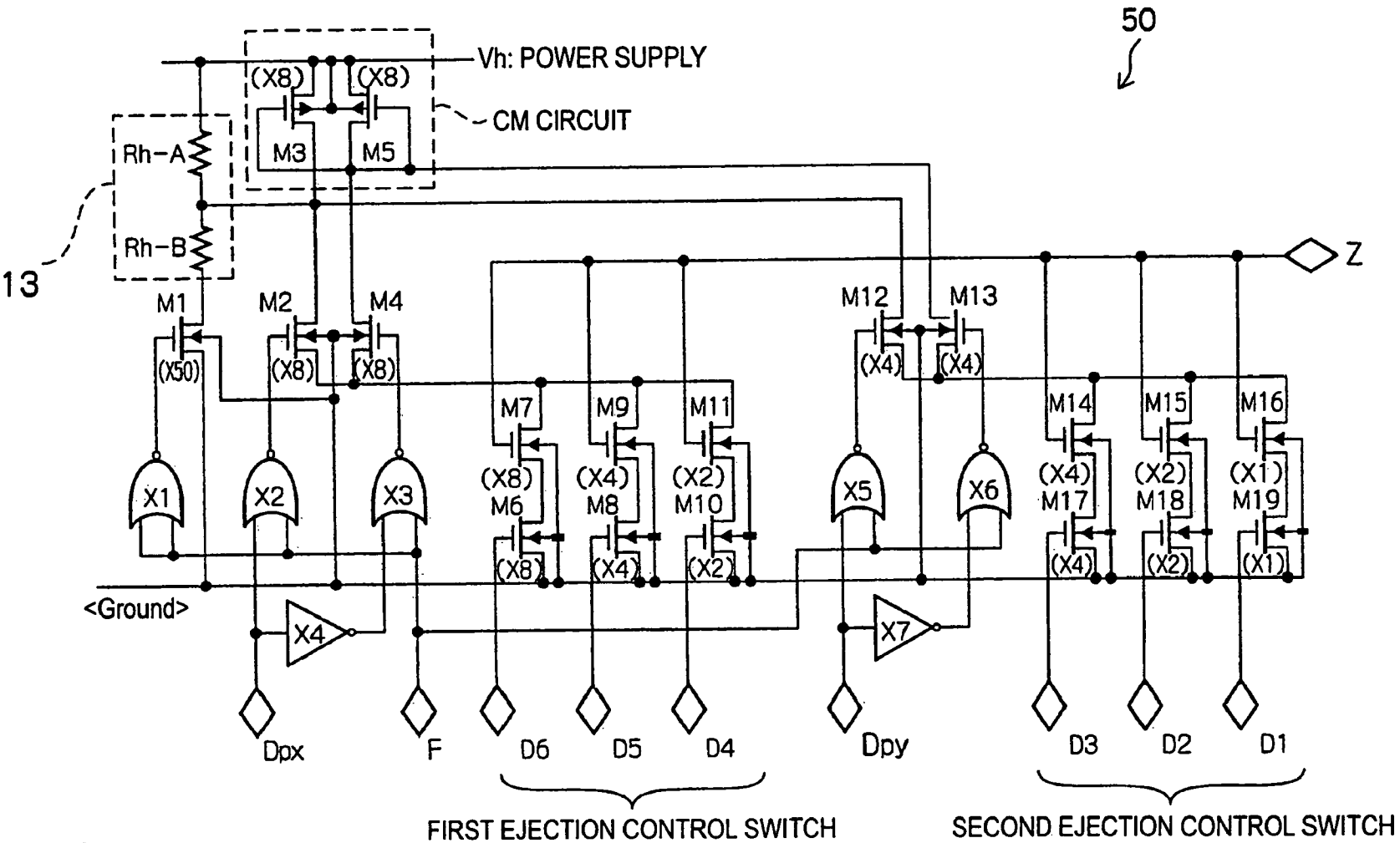
FIG. 27 is an ejection control circuit diagram according to an embodiment.
Figure 29:
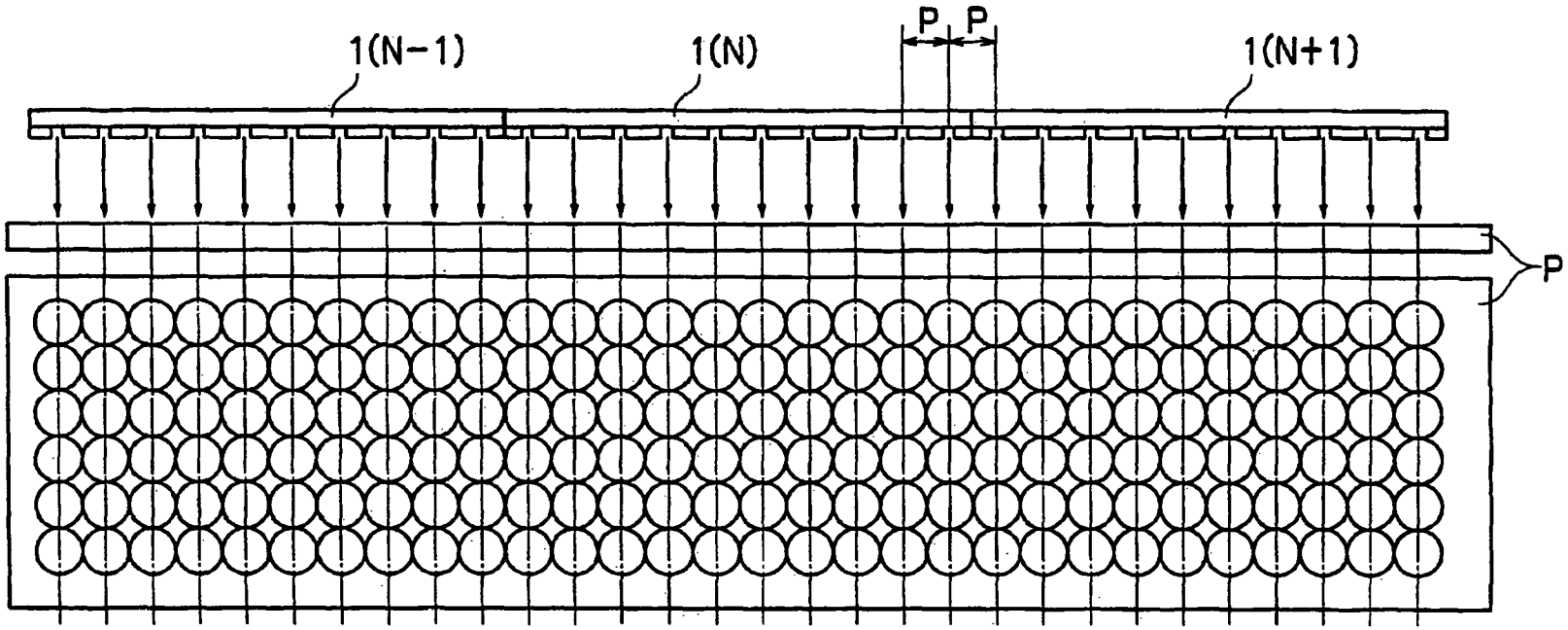
FIG. 29 is a drawing showing ejection directions of ink droplets and landing positions ink droplets in a line head having a plurality of heads 1 juxtaposed so as to connect the head 1 to the adjacent head 1.
Figure 30:
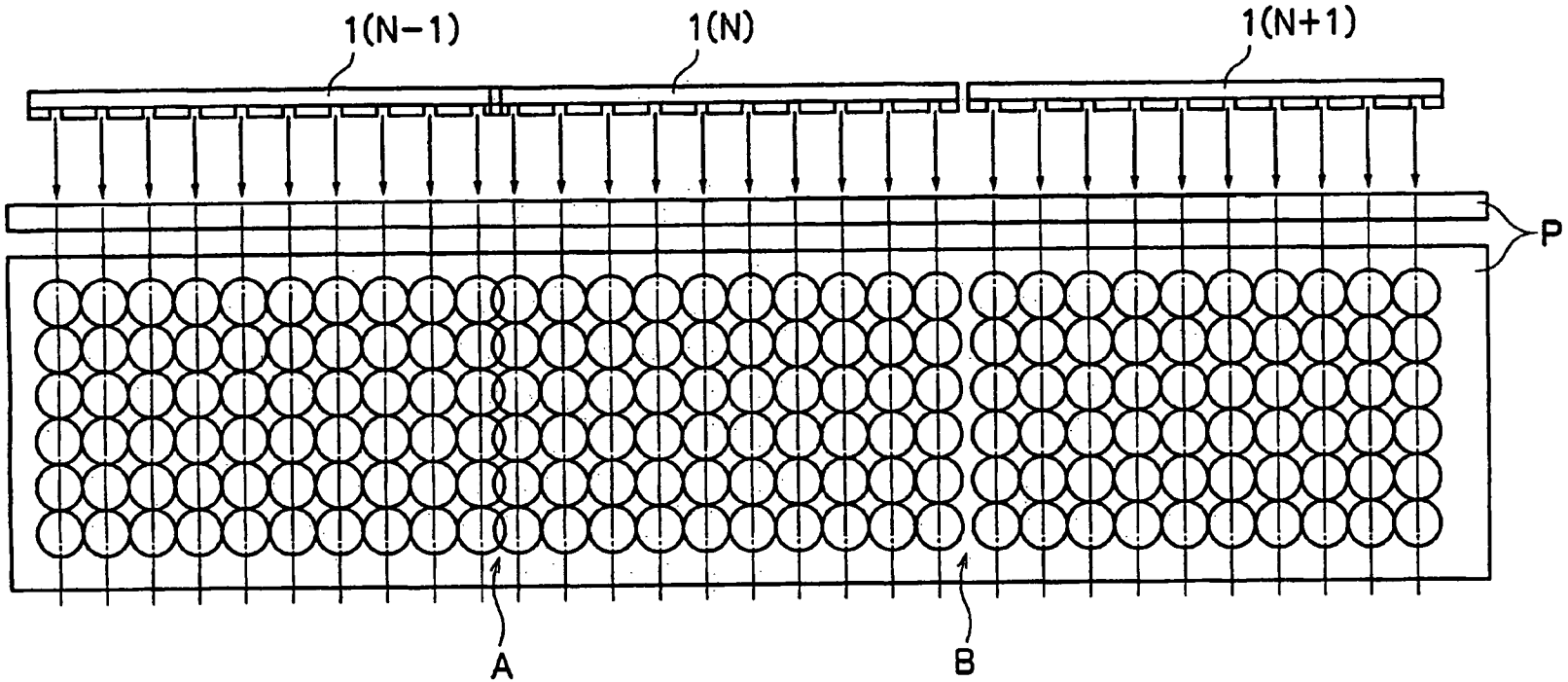
FIG. 30 is a drawing of an example in that the (N−1)th head is arranged close to the Nth head.
Figure 31:
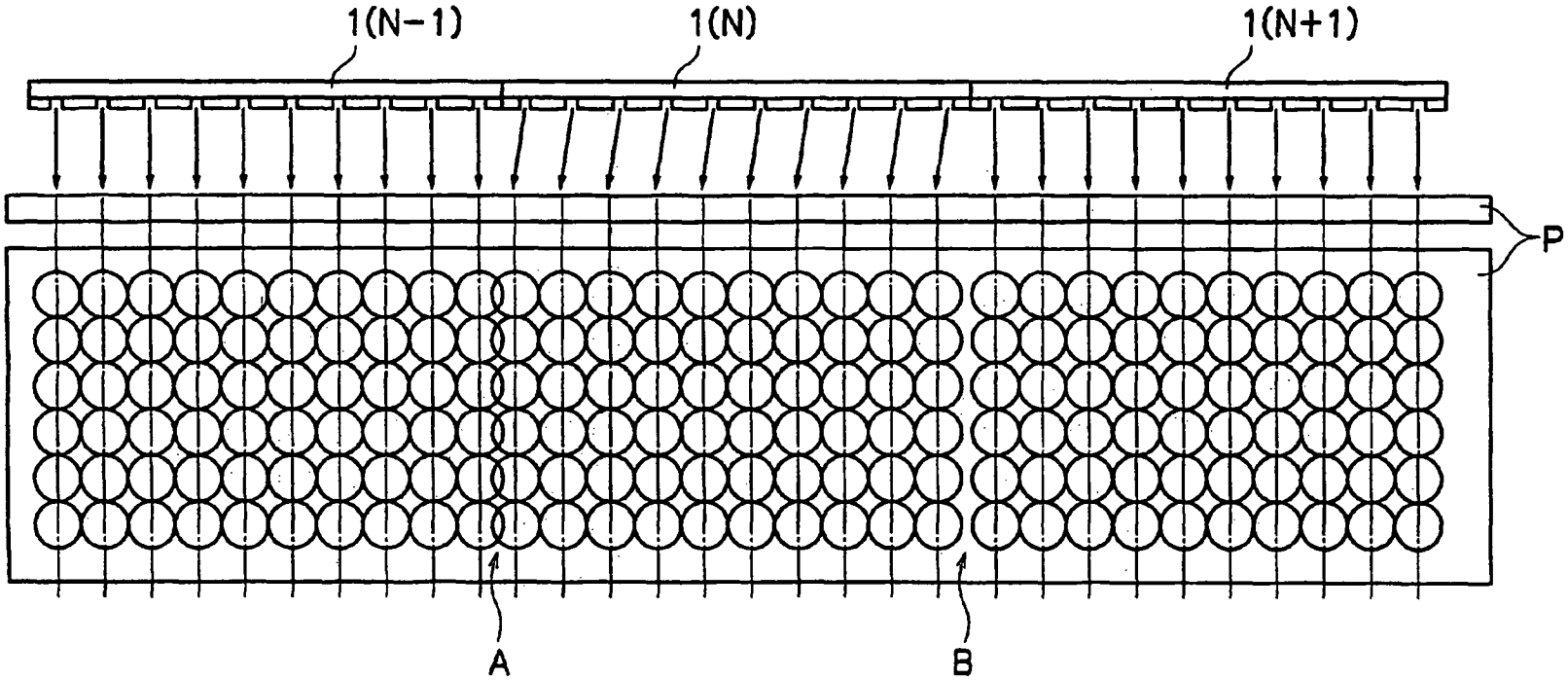
FIG. 31 is a drawing of an example in that the ejection direction of ink droplets ejected from each liquid ejection part of the Nth head is different from the ejection directions of other heads 1.

FIG. 27 is a drawing of an ejection-control circuit 50 according to the embodiment.

In the ejection control circuit 50, resistors Rh-A and Rh-B are the two heating resistors 13, respectively, which are divided into two within the ink chamber 12 and connected together in series. The resistance value of each heating resistor 13 herein is established substantially identically. Hence, by passing the same amount of electric current through the heating resistors 13 connected in series, ink droplets can be ejected from the nozzle 18 without deflection (in arrow direction shown by a dotted line in FIG. 5).

On the other hand, between the two heating resistors 13 connected together in series, the current mirror circuit (referred to as a CM circuit below) is connected. Through the CM circuit, by passing current between the heating resistors 13 or by discharging the current from between the heating resistors 13, the amount of current passing through each heating resistor 13 is differentiated, thereby changing the ejection direction of ink droplets into a plurality of directions in the arranging direction of the nozzles 18 (liquid ejection parts).

A power supply Vh is for applying voltage across the resistors Rh-A and Rh-B. Furthermore, the ejection control circuit 50 includes transistors M1 to M19. In addition, numerals (×N) (N=1, 2, 4, 8, or 50) attached to the transistors M1 to M19 and enclosed in parentheses show juxtaposing states of elements. For example, numeral (×1) (for the transistors M16 and M19) shows that a standard element is included. Similarly, numeral (×2) shows that an element equivalent to two standard elements connected in parallel is included. Numeral (×N) shows below that an element equivalent to N standard elements connected in parallel is included.

The transistor M1 functions as a switching element for turning on/off the current supply to the resistors Rh-A and Rh-B. When the drain of the transistor M1 is connected to the resistor Rh-B in series so that zero is entered into an ejection execution input switch F, the transistor M1 is turned on so as to pass current through the resistors Rh-A and Rh-B. In addition, the ejection execution input switch F is negative logic according to the embodiment for convenience of IC design so as to input zero during driving (only when ink droplets are ejected). When F=0 is entered, the input to an NOR gate X1 is (0, 0), so that the output becomes 1 so as to turn on the transistor M1.

According to the embodiment, when ink droplets are ejected from one nozzle 18, the ejection execution input switch F is turned 0 (on) only during period 1.5 μs (1/64), so that electric power is supplied from the power supply Vh (about 9 v) to the resistors Rh-A and Rh-B. The period 94.5 μs (63/64), during which the ejection execution input switch F is turned 1 (off), is allocated for an ink replenishing period to the ink chamber 12 of the liquid ejection part that has been ejected ink droplets.

Polarity changing switches Dpx and Dpy are switches for determining the ejection direction of ink droplets in any one of the left and the right.

Furthermore, first ejection control switches D4, D5, and D6 and second ejection control switches D1, D2, and D3 are switches for determining the deflection when ink droplets are ejected with deflection.

The transistors M2 and M4 and the transistors M12 and M13 function as operational amplifiers (switching elements) for the CM circuit, respectively. That is, these transistors M2 and M4, and M12 and M13 are for passing the electric current between the resistors Rh-A and Rh-B or for discharging the current from between the resistors Rh-A and Rh-B via the CM circuit.

Furthermore, the transistors M7, M9, and M11 and the transistors M14, M15, and M16 are elements to be a constant current source of the MC circuit, respectively. The respective drains of the transistors M7, M9, and M11 are connected to the sources and the back gates of the transistors M2 and M4. Similarly, the respective drains of the transistors M14, M15, and M16 are connected to the sources and the back gates of the transistors M12 and M13.

Among these transistors functioning as the constant current source, the transistor M7 has a capacitance (×8); the transistor M9 has a capacitance (×4); and the transistor M11 has a capacitance (×2). These three transistors M7, M9, and M11 connected together in parallel constitute a current source element group.

Similarly, the transistor M14 has a capacitance (×4); the transistor M15 has a capacitance (×2); and the transistor M16 has a capacitance (×1). These three transistors M14, M15, and M16 connected together in parallel constitute the current source element group.

Furthermore, to the transistors M7, M9, and M11 and the transistors M14, M15, and M16, which are functioning as current source elements, the transistors having the same current capacitance as that of each transistor (the transistors M6, M8, and M10 and the transistors M17, M18, and M19) are connected. To the gates of the transistors M6, M8, and M10 and the transistors M17, M18, and M19, the first ejection control switches D6, D5, and D4 and the second ejection control switches D3, D2, and D1 are connected.

Accordingly, when the first ejection control switch D6 is turned on and an appropriate voltage Vx is applied between an amplitude control terminal Z and the ground, for example, the transistor M6 is turned on, so that a current when the voltage Vx is applied passes through the transistor M7.

In such a manner, the first ejection control switches D6, D5, and D4 and the second ejection control switches D3, D2, and D1 are controlled to turn on/off, and hence the transistors M6 to M11 and the transistors M14 to M19 can be controlled to turn on/off.

Since the number of elements respectively connected in parallel to the transistors M7, M9, and M11 and the transistors M14, M15, and M16 herein is different, in FIG. 27, in proportion to numerals enclosed in parentheses of the transistors M7, M9, and M11 and the transistors M14, M15, and M16, electric current passes from the transistor M2 to M7; from the transistor M2 to M9; from the transistor M2 to M11; from the transistor M12 to M14; from the transistor M12 to M15; and from the transistor 12 to M16.

Accordingly, since the ratio of the transistors M7, M9, and M11 is (×8), (×4), and (×2), the ratio of the respective drain currents Id is 8:4:2. Similarly, since the ratio of the transistors M14, M15, and M16 is (×4), (×2), and (×1), the ratio of the respective drain currents Id is 4:2:1.

Then, the current flow when the first ejection control switches D4, D5, and D6 are noted in the ejection control circuit 50 in FIG. 27 will be described.

First, when F=0 (on) and Dpx=0, the input to the NOR gate X1 is (0, 0), so that the output becomes 1 so as to turn the transistor M1 on. The input to the NOR gate X2 is (0, 0), so that the output becomes 1 so as to turn the transistor M2 on. Furthermore, in the above case (F=0 (on) and Dpx=0), the input to the NOR gate X3 is (1, 0) (because one is the input of F=0 and the other Dpx=0 is the input 1 through an NOT gate X4). Accordingly, the output of the NOR gate X3 is 0 so as to turn the transistor M4 off.

In this case, while the electric current flows from the transistor M3 to M2 (because the transistor M2 is on), the electric current does not flow from the transistor M5 to M4 (because the transistor M4 is off). Moreover, by the characteristics of the CM circuit, when the electric current does not flow through the transistor M5, the electric current does not flow also through the transistor M3.

In this state, when a voltage of the power supply Vh is applied, since the transistors M3 and M5 are off so as not to pass a current, the entire current flows through the resistor Rh-A without branching toward the transistors M3 and M5. Since the transistor M2 is on, the current flowing through the resistor Rh-A branches toward the resistor Rh-B and the transistor M2 so that the current can discharge into the transistor M2. In this case, if the entire first ejection control switches D4 to D6 are off, since the current does not flow through the transistors M7, M9, and M11, the current cannot discharge into the transistor M2 finally. Accordingly, the entire current flowing through the resistor Rh-A passes through the resistor Rh-B. Then, the current flowing through the resistor Rh-B is fed to the ground after flowing through the transistor M1, which is turned on.

Whereas, if at least one of the first ejection control switches D6 to D4 is on, the transistor M6, M8, or M10, which corresponds to the turned-on first ejection control switch, is turned on, and any one of the transistor M7, M9, and M11, which is connected to the former transistor, is further turned on.

Accordingly, in the above-case, if the first ejection control switch D6 is on, for example, the current flowing through the resistor Rh-A branches toward the transistor M2 and the resistor Rh-B so as to discharge into the transistor M2. Then, the current flowing through the transistor M2 is fed to the ground via the transistors M7 and M6.

That is, when F=0 (on) and Dpx=0, if at least one of the first ejection control switches D6 to D4 is on, the entire current passes through the resistor Rh-A without branching toward the transistors M3 and M5, and then branches toward the transistor M2 and the resistor Rh-B.

Thereby, current I flowing through the resistors Rh-A and Rh-B is to be I(Rh-A)>I(Rh-B) (note: I() denotes a current flowing through ).

On the other hand, when F=0 (on) and Dpx=0 are entered, in the same way as the above, since the input to NOR gate X1 is (0, 0), the output is 1 and the transistor M1 is turned on. Also, since the input to NOR gate X2 is (1, 0), the output is 0 and the transistor M2 is turned off. Furthermore, since the input to NOR gate X3 is (0, 0), the output is 1 and the transistor M4 is turned on. When the transistor M4 is on, the current flows through the transistor M5 as well as the transistor M3 because of characteristics of the CM circuit.

Thus, when a voltage of the power supply Vh is applied, a current flows through the resistor Rh-A and the transistors M3 and M5. Then, the entire current flowing through the resistor Rh-A is passed to the resistor Rh-B (because the transistor M2 is off so that the current flowing through the resistor Rh-A does not branch toward the transistor M2). Also, the entire current flowing through the transistor M3 is passed to the resistor Rh-B because the transistor M2 is off.

Hence, to the resistor Rh-B, the current flowing through the transistor M3 is passed in addition to the current flowing through the resistor Rh-A. As a result, current I flowing through the resistors Rh-A and Rh-B is to be I(Rh-A)<I(Rh-B).

In addition, in the above-case, the transistor M4 is required to be on for the current to flow through the transistor M5. When F=0 and Dpx=0 are entered as described above, the transistor M4 is on.

Moreover, for the current to flow through the transistor M4, it is required that at least one of the transistors M7, M9, and M11 is turned on. Thus, in the same way as that when F=0 and Dpx=0 described above, it is necessary that at least any one of the first ejection control switches D6 to D4 is turned on. That is, if the entire first ejection control switches D6 to D4 are turned off, the situation when F=0 and Dpx=1 becomes identical to that when F=0 and Dpx=0, so that the entire current flowing through the resistor Rh-A is passed to the resistor Rh-B. Accordingly, if the resistance value of both the resistors Rh-A and Rh-B is set substantially identical, ink droplets are ejected without deflections.

In such a manner, while the ejection execution input switch F is turned on, the control turning on/off the polarity changing switch Dpx and the first ejection control switches D6 to D4 allows the current to discharge from between the resistors Rh-A and Rh-B or to be passed between the resistors Rh-A and Rh-B.

Since each capacity of the transistors M7, M9, and M11 functioning as current source elements is different, the control turning on/off the first ejection control switches D6 to D4 enables the amount of current discharged from the transistors M2 and M4 to be changed. That is, the control turning on/off the first ejection control switches D6 to D4 enables the current flowing through the resistors Rh-A and Rh-B to be changed.

Hence, while an appropriate voltage Vx is applied between the amplitude control terminal Z and the ground, individually operating the polarity changing switch Dpx and the first ejection control switches D4, D5, and D6 allows the landing position of ink droplets to be individually changed at multi-steps for each liquid ejection part.

Moreover, by changing the voltage Vx applied to the amplitude control terminal Z, the deflection for each step can be changed while the rate of the drain currents flowing through the transistors M7, M6, M9, M8, M11, and M10 remains as it is 8:4:2.

FIGS. 28A and 28B are tables showing states of the polarity changing switch Dpx and the first ejection control switches D6 to D4, and changes in landing positions of dots (ink droplets) in the arranging direction of the nozzles 18.

As shown in the tables of FIGS. 28A and 28B, when D4=0 (fixed), if (Dpx, D6, D5, D4) is (0, 0, 0, 0) as well as (1, 0, 0, 0), the landing positions of dots have no deflection (directly underneath the nozzle 18) in both the cases. This is as described above.

In such a manner, while the first ejection control switch D4 is fixed to be D4=0, the control with three bits of the polarity changing switch Dpx and the first ejection control switches D6 and D5 enables the landing positions of dots to be changed in steps at seven positions including the position without deflection. This means that the ejection of ink droplets can be set to have odd-numbered directions as shown in FIG. 12, for example.

Other than fixing the first ejection control switch D4 to be 0, when another first ejection control switch D6 or D5 is similarly changed to 0 or 1, changes at 15 positions other than seven are also enabled.

Whereas when D4=1 (fixed) as shown in FIG. 28B, the landing positions of dots can be evenly changed at 8 steps. This enables the landing positions of dots to be divided into four positions arranged on one side and four positions on the other with the position without deflection therebetween, and also to be arranged to have a bilateral symmetry about the position with the deflection=0.

That is, when D4=1 (fixed), the case where the landing position of dots is directly underneath the nozzle 18 (without deflection) can be eliminated. This means that the ejection of ink droplets, as shown in FIG. 11, can be set to have even-numbered directions (the case is not included where ink droplets are ejected directly underneath the nozzle 18).

The above-description relates to the first ejection control switches D4 to D6; however, the similar control can be also carried out in respect of the second ejection control switches D1 to D3.

Referring to FIG. 27, the second ejection control switches D3, D2, and D1 correspond to the first ejection control switches D6, D5, and D4, respectively. The transistors M12 and M13 connected to the second ejection control switches D1 to D3 correspond to the transistors M2 and M4 on the side of the first ejection control switches D4 to D6, respectively. The polarity changing switch Dpy further corresponds to the polarity changing switch Dpx. The transistors M14 to M19 functioning as current source elements also corresponds to the transistors M6 to M11, respectively.

On the side of the second ejection control switches D1 to D3, the capacity of the transistor M14 functioning as a current source element is different from that on the side of the first ejection control switches D4 to D6. The transistor M14 functioning as a current source element on the side of the second ejection control switches D1 to D3 is set to have a half capacity of the transistor M6 functioning as a current source element on the side of the first ejection control switches D4 to D6. Others are the same.

Hence, on the side of the second ejection control switches D1 to D3, in the same way as described above, by controlling the second ejection control switches D3 to D1 together with the polarity changing switch Dpy to be turned on/off, the current flowing through the resistors Rh-A and Rh-B can also be changed.

Changes in the current value by the control of the second ejection control switches D1 to D3 are smaller than those by the first ejection control switches D4 to D6. Thus, the variable pitch of the landing positions of ink droplets by the control of the second ejection control switches D1 to D3 is finer than that by the first ejection control switches D4 to D6.

The second ejection control switches D1 to D3 and the polarity changing switch Dpy are mainly used in executing the second ejection control means. Therefore, the control way as shown in FIG. 28B of FIGS. 28A and 28B may be rational. In FIGS. 28A and 28B herein, the polarity changing switch Dpx corresponds to the polarity changing switch Dpy; the first ejection control switches D6, D5, and D4 correspond to the second ejection control switches D3, D2, and D1, respectively. Thus, it is preferable that the ejection be controlled with the second ejection control switch D1 fixed to be D1=1 (however, the control corresponding to the table in FIG. 28B of FIGS. 28A and 28B may of course be possible).

In the ejection control circuit 50 shown in FIG. 27, the amplitude control terminal Z on the side of the first ejection control switches D4 to D6 is identical to that on the side of the second ejection control switches D1 to D3. Hence, if the voltage Vx applied to the amplitude control terminal Z is established in view of the control amount by the second ejection control switches D1 to D3, for example, the landing positions of ink droplets by the control of the first ejection control switches D4 to D6 are also determined on the basis of the voltage Vx.

Thereby, the ejection control is established to have a predetermined relationship between the ejection control of ink droplets on the side of the first ejection control switches D4 to D6 and that on the side of the second ejection control switches D1 to D3. Thus, if the ejection control of ink droplets (the space between the landing positions of ink droplets) is determined on any one side, based on the determined results, the ejection control of ink droplets (the space between the landing positions of ink droplets) is determined on the other side.

Such a way contributes to simplifying the control.

However, other than such a way, the amplitude control terminal Z on the side of the first ejection control switches D4 to D6 may also be provided separately from that on the side of the second ejection control switches D1 to D3. Thereby, the ejection direction of ink droplets (the landing position of ink droplets) can be established at more multi-steps.

The ejection control circuit 50 shown in FIG. 27 is provided for each liquid ejection part; however, the above-mentioned control is performed for each head 11.

That is, the switches of the ejection control circuit 50 are provided in one for each head 11. By turning the switches on/off in units of the head 11, the entire liquid ejection parts within the head 11 are turned on/off simultaneously. For example, in one head 11, by turning on/off one first ejection control switch D6, the first ejection control switches D6 of the entire liquid ejection parts of the head 11 are simultaneously turned on/off.

Accordingly, by controlling each switch to be turned on/off in units of the head 11, the ejecting-direction changing means or the principal control means and the auxiliary control means can be executed. When the principal control means and the auxiliary control means are executed, the auxiliary control execution determining means may store whether the auxiliary control means is executed for every heads 11 or not in a memory together with the on/off state of each switch when the means is executed. When the reference-direction setting means is executed together with the ejecting-direction changing means, i.e., when a reference principal direction is established for each head 11, the on/off state of each switch may be stored in units of the head 11 in the same way.

Furthermore, by changing the voltage Vx applied to the amplitude control terminal Z, the deflection (ejecting angle) per one step can be changed. When the ejecting-angle setting means is executed, by adjusting the voltage Vx applied to the amplitude control terminal Z so as to establish a desired ejecting angle for each head 11, the voltage Vx at this time may be stored in a memory.

The first ejection control means can be executed by controlling the first ejection control switches D4 to D6 to be turned on/off. Furthermore, the second ejection control means can be executed by controlling the second ejection control switches D1 to D3 to be turned on/off.

When the number of pixels increasing means is further executed, in FIG. 27, the first ejection control switches. D4 to D6 can also be used to make them serve a double purpose. When the first ejection control switches D4 to D6 are used as well as the number of pixels increasing means, it is preferable that the first ejection control switches D4 to D6 be changed to 0 or 1 so that the ejection direction be changed to 15 stages. That is, this is because the number of ejection directions capable of covering a plurality of ejection directions by the number of pixels increasing means and a plurality of ejection directions by the first ejection control means is required.

In addition, the first ejection control switches D4 to D6 are arranged in parallel with the second ejection control switches D1 to D3 so that the ejection control switches, the polarity changing switches, and the transistors for the number of pixels increasing means may be obviously provided separately.

The embodiment of the present invention has been described above; the present invention is not limited to the embodiment, so that various modifications can be made as follows:

(1) A J-bit control signal shown in FIGS. 11 to 14 is not limited to the number of bits exemplified in the embodiment, so that any number of bits can be employed.

(2) According to the embodiment, two-divided heating elements 13 are provided, and by changing a current passing through each of the heating resistors 13, the two heating resistors 13 are controlled for producing a time difference in the time reaching the boiling ink droplets (bubble generating time); the invention is not limited to this, and two-divided heating elements 13, each having the same resistance, may be juxtaposed while a difference in period for passing current may be produced. For example, when a switch is independently provided for each of two-divided heating elements 13 so as to turn each switch on with a time difference, a time difference in the time reaching the generating bubbles in ink may be produced. Furthermore, a combination may also be employed of changing the current flowing through each of the heating element 13 with having a time difference in the period for passing current.

(3) According to the embodiment, an example is shown in that the two heating resistors 13 are juxtaposed, and this is because durability of division into two has been sufficiently proved, and a circuit structure can be simplified. However, the invention is not limited to this, and within one ink chamber 12, juxtaposed three or more heating resistors 13 may be used.

(4) According to the embodiment, the heating resistor 13 is exemplified as an example of bubble generating means or a heating element; alternatively, a component other than a resistor may be employed. Also, other than a heating element, an energy-generating element of another type may be used. For example, there may be an energy-generating element of an electrostatic ejection system and that of a piezoelectric system.

The energy-generating element of an electrostatic ejection system includes a resonant panel and two electrodes disposed underneath the resonant panel with an air space therebetween. The resonant panel is deflected downward by applying a voltage between both the electrodes, and then, the voltage is turned to 0 V so as to release an electrostatic force. Utilizing an elastic force produced when the resonant panel is returned to the original state, ink droplets are ejected.

In this case, in order to produce a difference in energy generating for each energy-generating element, when the resonant panel is returned to the original (the voltage is turned to 0 V so as to release an electrostatic force), a time difference may be produced between two energy-generating elements, or the voltage may be changed for two energy-generating elements, for example.

The energy-generating element of a piezoelectric system is made of a composite composed of a piezoelectric element having electrodes disposed on both sides and a resonant panel. When a voltage is applied to the electrodes on both sides of the piezoelectric element, a bending moment is produced in the resonant panel by a piezoelectric effect so as to deflect the resonant panel. By utilizing this deflection, ink droplets are ejected.

Also in this case, in the same way as above, in order to produce a difference in energy generating for each energy-generating element, when the voltage is applied to the electrodes on both sides of the piezoelectric element, a time difference may be produced between two piezoelectric elements, or the voltage may be changed for two piezoelectric elements.

(5) According to the embodiment, the ejection direction of ink droplets is enabled to deflect in the arranging direction of liquid ejection parts (the nozzles 18). This is because the heating resistors 13 divided in the arranging direction of liquid ejection parts are juxtaposed. However, it is not necessarily that the arranging direction of liquid ejection parts perfectly agree with the deflection direction of ink droplets, so that even when some disagree is exhibited, substantially the same effect can be expected as that when the arranging direction of liquid ejection parts perfectly agrees with the deflection direction of ink droplets. Hence, such disagree is no problem.

(6) in the second ejection control means, when on one pixel region, ink droplets are randomly landed at M different positions, M is not limited to the numbers shown in the embodiment, any number may be employed as long as M may be positive integers of 2 or more.

(7) In the second ejection control means according to the embodiment, the landing positions of ink droplets are randomly changed for one pixel region so that the center of landed ink droplets is included within the pixel region; the invention is not limited to this, and when at least part of landed ink droplets is included in the pixel region, the landing positions can be dispersed in more than the range of the embodiment.

(8) In the second ejection control means according to the embodiment, a random number generator is employed as a method for randomly determining the landing positions of ink droplets; however, any method may be employed as long as the selected landing position has no regularity. Furthermore, as a method for generating random numbers, there are also a square center method, a congruence method, a shift resister method, for example. As a method other than a random method, a method repeating a plurality of combinations of specific numeric numbers may be employed, for example.

(9) According to the embodiment, the printer is incorporated into the head 11; however, the present invention is not limited to the printer, so that various liquid ejection apparatuses may be applied. For example, the head 11 may also be applied to an apparatus for ejecting a solution including a DNA for detecting a biological material.

INDUSTRIAL APPLICABILITY

According to the present invention, even when a unit head has a positional displacement relative to another unit head, or when ejection characteristics such as an ejection direction are different, stripe non-uniformity can be made in inconspicuous states by correcting the ejection direction of the unit head. Thereby, printing quality can be improved.

The invention claimed is:

1. A liquid ejection apparatus having a line head formed with a plurality of liquid ejection unit heads, each unit head having a plurality of liquid ejection parts for ejecting ink droplets from a nozzle, the liquid ejection apparatus comprising:

ejection direction changing means enabling the ejection direction of liquid droplets ejected from the nozzle of each of the liquid ejection part to change in two different directions in the arranging direction of the liquid ejection parts; and reference-direction setting means for individually setting one reference principal direction for each unit head among a plurality of ejection directions of liquid droplets provided by the ejection direction changing means based on analysis of a printed test pattern.

2. The apparatus according to claim 1, further comprising ejection control means for controlling liquid-droplet ejection so as to form one pixel line or one pixel using at least two different liquid ejection parts by ejecting ink droplets in different directions, using the ejection direction changing means, from at least two different liquid ejection parts arranged in the vicinity so as to land liquid droplets on the same pixel line so as to form the pixel line or by landing liquid droplets on the same pixel region so as to form the pixel.

3. The apparatus according to claim 1, further comprising ejection control means for controlling liquid-droplet ejection in that a pixel line is formed by ejecting liquid droplets in different directions from at least two different liquid ejection parts arranged in the vicinity so as to land liquid droplets on the same pixel line using the ejection direction changing means, or the one pixel line or one pixel is formed by landing liquid droplets on the same pixel region so as to form the pixel using at least two different liquid ejection parts arranged in the vicinity.

4. The apparatus according to claim 1, further comprising:

first ejection control means for controlling liquid-droplet ejection in that a pixel line is formed by ejecting liquid droplets in different directions from at least two different liquid ejection parts arranged in the vicinity so as to land liquid droplets on the same pixel line using the ejection direction changing means, or the one pixel line or one pixel is formed by landing liquid, droplets on the same pixel region so as to form the pixel using at least two different liquid ejection parts arranged in the vicinity; and second ejection control means for controlling liquid-droplet ejection in that when liquid droplets are landed on a pixel region, for each liquid-droplet ejection from the liquid ejection part, any one of M different landing positions (M: integers of 2 or more), at least part of which is included within the pixel region, is determined as a landing position of liquid droplets in the arranging direction of liquid ejection parts in the pixel region so that the ejection is controlled using the ejection direction changing means so as to land liquid droplets at the determined position.

5. The apparatus according to claim 1, further comprising number of pixels increasing means in that using the ejecting-direction changing means, liquid droplets ejected from each liquid ejection part are controlled so as to land at two or more different positions in the arranging direction of liquid ejection parts, so that the number of pixels is increased more than that formed by landing liquid droplets from each liquid ejection part at one position.

6. The apparatus according to claim 1, further comprising;

number of pixels increasing means in that using the ejecting-direction changing means, liquid droplets ejected from each liquid ejection part are controlled so as to land at two or more different positions in the arranging direction of liquid ejection parts, so that the number of pixels is increased more than that formed by landing liquid droplets from each liquid ejection part at one position; and ejection control means for controlling liquid-droplet ejection in that a pixel line is formed by ejecting liquid droplets in different directions from at least two different liquid ejection parts arranged in the vicinity so as to land liquid droplets on the same pixel line using the ejection direction changing means, or the one pixel line or one pixel is formed by landing liquid droplets on the same pixel region so as to form the pixel using at least two different liquid ejection parts arranged in the vicinity.

7. The apparatus according to claim 1, further comprising:

number of pixels increasing means in that using the ejecting-direction changing means, liquid droplets ejected from each liquid ejection part are controlled so as to land at two or more different positions in the arranging direction of liquid ejection parts, so that the number of pixels is increased more than that formed by landing liquid droplets from each liquid ejection part at one position; and ejection control means for controlling liquid-droplet ejection in that when liquid droplets are landed on a pixel region, for each liquid-droplet ejection from the liquid ejection part, any one of M different landing positions (M: integers of 2 or more), at least part of which is included within the pixel region, is determined as a landing position of liquid droplets in the arranging direction of liquid ejection parts in the pixel region so that the ejection is controlled using the ejection direction changing means so as to land liquid droplets at the determined position.

8. The apparatus according to claim 1, further comprising:

number of pixels increasing means in that using the ejecting-direction changing means, liquid droplets ejected from each liquid ejection part are controlled so as to land at two or more different positions in the arranging direction of liquid ejection parts, so that the number of pixels is increased more than that formed by landing liquid droplets from each liquid ejection part at one position;

first ejection control means for controlling liquid-droplet ejection in that a pixel line is formed by ejecting liquid droplets in different directions from at least two different liquid ejection parts arranged in the vicinity so as to land liquid droplets on the same pixel line using the ejection direction changing means, or the one pixel line or one pixel is formed by landing liquid droplets on the same pixel region so as to form the pixel using at least two different liquid ejection parts arranged in the vicinity; and second ejection control means for controlling liquid-droplet ejection in that when liquid droplets are landed on a pixel region, for each liquid-droplet ejection from the liquid ejection part, any one of M different landing positions (M: integers of 2 or more), at least part of which is included within the pixel region, is determined as a landing position of liquid droplets in the arranging direction of liquid ejection parts in the pixel region so that the ejection is controlled using the ejection direction changing means so as to land liquid droplets at the determined position.

9. The apparatus according to claim 1, wherein the liquid ejection part comprises:

a liquid chamber for accommodating liquid to be ejected;

bubble generating means arranged within the liquid chamber for generating bubbles in liquid contained in the liquid chamber by supplying energy; and a nozzle member having a nozzle for ejecting liquid contained in the liquid chamber in operatively associated with generation of bubbles, and wherein the ejection direction changing means comprises:

principal control means for ejecting liquid droplets from the nozzle by supplying energy to the bubble generating means; and auxiliary control means for controlling liquid droplets to be ejected in a direction different from that of liquid droplets ejected by the principal control means by supplying energy to the bubble generating means in a different way from that of the principal control means.

10. The apparatus according to claim 1, wherein the liquid ejection part comprises:

a liquid chamber for accommodating liquid to be ejected;

a heating element arranged within the liquid chamber for generating bubbles in the liquid contained in the liquid chamber by supplying energy; and a nozzle member having a nozzle for ejecting liquid contained in the liquid chamber, wherein a plurality of the heating elements are juxtaposed in the one liquid chamber in the arranging direction of the liquid ejection parts, and are connected together in series, and wherein ejection direction changing means comprises a circuit having a switching element connected between the heating elements connected together in series, and controls the ejection direction of liquid droplets to be ejected in at least two directions in the arranging direction of, liquid ejection parts by passing electric current between the heating elements through the circuit or by discharging electric current from between the heating elements through the circuit so as to control electric current for supplying to each heating element.

11. A liquid ejecting method using a line head having a plurality of liquid ejection unit heads, each unit head having a plurality of liquid ejection parts for ejecting ink droplets from a nozzle, the liquid ejecting method comprising:

individually setting one reference principal direction for each unit head among a plurality of ejection directions based on analysis of a printed test pattern; and individually setting one ejecting angle of liquid droplets for each of the unit head.

* * * * *